US012492478B2

(12) United States Patent
Fujii et al.

(10) Patent No.: US 12,492,478 B2
(45) Date of Patent: Dec. 9, 2025

(54) COATED AND PLATED STEEL SHEET OR COATED AND PLATED STEEL STRIP

(71) Applicant: NIPPON STEEL CORPORATION, Tokyo (JP)

(72) Inventors: Takashi Fujii, Tokyo (JP); Kohei Ueda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 180 days.

(21) Appl. No.: 18/547,879

(22) PCT Filed: Mar. 8, 2021

(86) PCT No.: PCT/JP2021/009004
§ 371 (c)(1),
(2) Date: Aug. 25, 2023

(87) PCT Pub. No.: WO2022/190173
PCT Pub. Date: Sep. 15, 2022

(65) Prior Publication Data

US 2024/0133041 A1 Apr. 25, 2024
US 2024/0229245 A9 Jul. 11, 2024

(51) Int. Cl.

| | |
|---|---|
| ***C23C 28/00*** | (2006.01) |
| ***C22C 18/04*** | (2006.01) |
| ***C22C 21/10*** | (2006.01) |
| ***C23C 2/06*** | (2006.01) |
| ***C23C 2/12*** | (2006.01) |
| ***C23C 2/26*** | (2006.01) |
| ***C23C 22/73*** | (2006.01) |
| ***C23C 22/82*** | (2006.01) |

(52) U.S. Cl.
CPC ..... *C23C 28/321* (2013.01); *C22C 18/04* (2013.01); *C22C 21/10* (2013.01); *C23C 2/06* (2013.01); *C23C 2/12* (2013.01); *C23C 2/26* (2013.01); *C23C 22/73* (2013.01); *C23C 22/82* (2013.01); *C23C 28/34* (2013.01); *C23C 28/345* (2013.01)

(58) Field of Classification Search
None
See application file for complete search history.

(56) References Cited

U.S. PATENT DOCUMENTS

| | | | | |
|---|---|---|---|---|
| 4,992,115 | A | 2/1991 | Ikeda | |
| 6,190,780 | B1 | 2/2001 | Shoji et al. | |
| 8,592,049 | B2 * | 11/2013 | Honda | C21D 9/46 428/641 |
| 2009/0017082 | A1 | 1/2009 | Morimitsu et al. | |
| 2011/0062026 | A1 | 3/2011 | Nishiguchi et al. | |
| 2015/0252480 | A1 | 9/2015 | Lapena Rey et al. | |
| 2016/0153107 | A1 * | 6/2016 | Nemoto | C09D 163/00 428/418 |
| 2019/0040531 | A1 | 2/2019 | Tsuneishi et al. | |

FOREIGN PATENT DOCUMENTS

| | | | | |
|---|---|---|---|---|
| JP | H02-25579 | A | 1/1990 | |
| JP | H05-43212 | A | 2/1993 | |
| JP | H10-337530 | A | 12/1998 | |
| JP | 2000-309879 | A | 11/2000 | |
| JP | 2001-158973 | A | 6/2001 | |
| JP | 2002-317279 | A | 10/2002 | |
| JP | 2009-179859 | A | 8/2009 | |
| JP | 2010-201353 | A | 9/2010 | |
| JP | 2011-084729 | A | 4/2011 | |
| JP | 2013-067699 | A | 4/2013 | |
| JP | 2015-057509 | A | 3/2015 | |
| JP | 5732672 | B2 * | 6/2015 | C23C 22/42 |
| JP | 2016-194134 | A | 11/2016 | |
| JP | 2020-066793 | A | 4/2020 | |
| WO | 2007/094253 | A1 | 8/2007 | |
| WO | 2017/138464 | A1 | 8/2017 | |

* cited by examiner

*Primary Examiner* — Daniel J. Schleis
(74) *Attorney, Agent, or Firm* — SOLARIS Intellectual Property Group, PLLC

(57) ABSTRACT

A coated and plated steel sheet or coated and plated steel strip including: a steel sheet or a steel strip; a plating layer provided on one surface or both surfaces of the steel sheet or steel strip and containing zinc; a chemical conversion coating provided on the plating layer provided on one surface of the steel sheet or steel strip or provided on at least one of the plating layers provided on both surfaces of the steel sheet or steel strip; and a single-layer or multilayer coating film provided on the chemical conversion coating, in which the single-layer coating film in contact with the chemical conversion coating or the coating film, of the multilayer coating film, which is in contact with the chemical conversion coating, contains a cerium compound capable of being dissolved in an amount of 0.10 g or more with respect to 100 g of water at room temperature at a concentration of from 0.01 to 10.0% by mass, with respect to a solid content of the single-layer coating film in contact with the chemical conversion coating or the coating film, of the multilayer coating film, which is in contact with the chemical conversion coating.

9 Claims, No Drawings

COATED AND PLATED STEEL SHEET OR COATED AND PLATED STEEL STRIP

TECHNICAL FIELD

The present disclosure relates to a coated and plated steel sheet or a coated and plated steel strip.

BACKGROUND ART

For home electric appliances, building materials, or the like, a pre-coated steel sheet coated with a colored organic coating has come to be used in place of a conventional post-coated steel sheet product coated after molding processing. The pre-coated steel sheet is obtained by coating a rustproof steel sheet or a plated steel sheet with a colored organic coating, and has a property of having sufficient processability and favorable corrosion resistance while having a beautiful appearance.

A pre-coated steel sheet (hereinafter, also referred to as a coated steel sheet) is a steel sheet that is shipped after a coating film required for a product by a consumer is formed in advance, and the consumer can omit coating and work related thereto, and equipment for such work becomes unnecessary, so that the use of the pre-coated steel sheet is expanding in various fields. In an initial pre-coated steel sheet, a chromate chemical conversion-treated steel sheet subjected to a rust prevention treatment with chromate has been used as a base steel sheet to be coated. Thereafter, due to the toxicity problem of hexavalent chromium which may be eluted from a chromate chemical conversion coating, a chromate-free coated steel sheet using a base steel sheet subjected to a hexavalent chromium-free rust prevention treatment has attracted attention instead of a chromate chemical conversion coated steel sheet, and in recent years, the use of the chromate-free coated steel sheet has been particularly increased in the field of home electric appliances. In the field of building materials requiring long-term corrosion resistance outdoors, a chromate coated steel sheet has been mainly used.

For the purpose of expanding the application of a chromate-free coated steel sheet to the field of building materials, many studies have been conducted so far in order to realize high corrosion resistance of a chromate chemical conversion treatment also by a chromate-free treatment. However, provision of a chromate-free treatment that sufficiently satisfies required performance has not been achieved.

In recent years, corrosion resistance of a plated steel sheet as abase of a chromate-free treatment has been increased, and a zinc alloy-based plated steel sheet to which aluminum, magnesium, silicon, or the like is added is also used from a zinc plated steel sheet, which has been a mainstream heretofore, and thus, a chromate-free treatment having high corrosion resistance is also required for these zinc alloy-based plated steel sheets.

So far, studies on a chromate-free post-treatment of a plated steel sheet having a plating layer containing zinc have been made.

For example, Patent Literature 1 discloses "a surface-treated metal plate coated with a coating containing rare earth metal element compounds and a resin matrix physically holding these compounds on a metal plate surface and having an adhesion force to a metal plate as main components, and a metal surface treatment liquid used for the surface-treated metal plate".

According to Patent Literature 1, it is described that "it is possible to provide a surface-treated metal plate and a metal surface treatment liquid which are excellent corrosion resistance, do not use hexavalent chromium at all, and greatly reduce an environmental load".

Patent Literature 2 discloses "a surface-treatment coating for a zinc-based plated steel sheet with which generation of white rust is suppressed by using a coating mainly containing an oxide and/or hydroxide of Ce and an oxide and/or hydroxide of Si". Patent Literature 2 describes that "it is preferable that the ratio of the oxide and/or hydroxide of Ce with respect to the total oxide in the coating is from 0.10 to 0.60; the ratio of the oxide and/or hydroxide of Si with respect to the total oxide in the coating is in a range of from 0.2 to 0.8, and the ratio of $SiO_2$ in the oxide and/or hydroxide of Si is from 0.15 to 0.90."

According to Patent Literature 2, it is described that "it is possible to provide a novel non-chromate-treated steel sheet capable of suppressing the generation of white rust caused by zinc even when treatment is performed with a treatment bath not containing harmful ions."

Patent Literature 3 discloses "a surface treatment agent for aluminum or an alloy thereof containing from 10 to 500 parts by weight of zirconium ions, from 10 to 500 parts by weight of phosphate ions, and from 1 to 50 parts by weight of effective fluorine ions, with respect to from 10 to 1000 parts by weight of cerium ions, and 2) a surface treatment bath for aluminum or an alloy thereof containing from 10 to 500 ppm of zirconium ions, from 10 to 500 ppm of phosphate ions, and from 1 to 50 ppm of effective fluorine ions, with respect to from 10 to 1000 ppm of cerium ions."

Patent Literature 4 describes "a surface-treated steel sheet with excellent corrosion resistance, including: a surface-treatment coating having a coating film thickness of from 0.01 to 1.0 μm formed by applying and drying a surface treatment composition containing the following components (a) to (c) on a surface of a zinc-based plated steel sheet:

(a) an aqueous epoxy resin dispersion,
(b) a silane coupling agent, and
(c) phosphoric acid and/or a hexafluorometallic acid; and an upper layer coating having a coating film thickness of from 0.3 to 2.0 μm formed by applying and drying a coating composition for an upper layer coating containing the following components (D) to (G) on an upper layer of the surface-treatment coating:

(D) a resin solution obtained by reacting a compound (d2) having two or more carboxyl groups in one molecule and a hydrazine derivative (d3) having an active hydrogen with a bisphenol A-type epoxy resin (d1),
(E) a curing agent having a functional group reacting with a hydroxyl group,
(F) a non-chromium based rust inhibitor, and
(G) a composite solid lubricant".

Patent Literature 5 discloses "a surface-treated metal plate including an intermediate layer containing an oxide, hydroxide, oxyacid compound and/or hydrogen oxyacid compound of a group IVA element as a main component, and a corrosion-resistant coating layer containing an oxyacid compound or hydrogen oxyacid compound of a rare earth and/or a group IVA element or a mixture thereof as a main component (however, the intermediate layer and the corrosion-resistant coating layer do not have the same composition)".

Studies on pigments have also been made.

For example, Patent Literature 6 discloses "a colored metallic pigment containing at least a metallic pigment, an amorphous silicon oxide film layer formed on the surface of the metallic pigment, a metal layer formed on a surface of the amorphous silicon oxide film layer, metallic particles formed on a surface of the metal layer, in which metallic particles are so formed as to directly cover a part of the metal layer".

According to Patent Literature 6, it is described that weather resistance is improved by forming a layer obtained by applying and drying a coating material containing the colored metallic pigment to a steel sheet subjected to a zinc phosphate-based chemical conversion treatment and intermediate coating.

Patent Literature 7 discloses "a rust preventive pigment composition containing, as an active ingredient, a mixed composition of apatite represented by the following general formula: $Me_{(0.5m+1.5n)}(X)_m \cdot (PO_4)_n$ [where Me represents Ca, Mg, or Ba, X represents OH, F, $CO_3$, $NO_3$, or $NO_2$, and m and n represent coefficients] and another hardly soluble metal phosphate."

According to Patent Literature 7, it is described that weather resistance of a steel sheet is improved by applying the rust preventive pigment composition to the steel sheet and drying the rust preventive pigment composition.

Studies on a cationic electrodeposition coating composition containing no chromium compound have also been made.

For example, Patent Literature 8 discloses "a cationic electrodeposition coating composition containing an amino group-containing modified epoxy resin (A), a blocked polyisocyanate curing agent (B), a phenol resin (C), a metal compound (D), and a nitrogen oxide ion (E)".

According to Patent Literature 8, it is described that a coated article excellent in anti-corrosion properties on a steel sheet can be obtained by using the cationic electrodeposition coating composition.

Studies on a chromate-free post-treatment of an aluminum material have also been made.

For example, Patent Literature 9 discloses "a surface treatment agent containing a water-soluble or water-dispersible organic polymer (A) having a carbonyl group and/or a hydroxyl group in a unit structure and an organic compound (B) having a phosphonic group".

According to Patent Literature 9, it is described that "it is possible to provide a non-chromate surface treatment agent that, without using one or two or more iron group compounds selected from oxides, hydroxides, or oxyhydroxides of iron, nickel, or cobalt, or the like, allows a surface-treatment coating having excellent adhesion to an aluminum material or the like and an upper layer coating and providing excellent corrosion resistance to the aluminum material or the like to be formed between the aluminum material or the like and the upper layer coating, a method of producing a surface-treatment coating using the surface treatment agent, and an aluminum material or aluminum alloy material having the surface-treatment coating".

Patent Literature 1: Japanese Patent Application Laid-Open (JP-A) No. H10-337530
Patent Literature 2: JP-A No. 2001-158973
Patent Literature 3: JP-A No. H2-25579
Patent Literature 4: JP-A No. 2010-201353
Patent Literature 5: JP-A No. 2000-309879
Patent Literature 6: WO 2007/094253 A
Patent Literature 7: JP-A No. H5-43212
Patent Literature 8: JP-A No. 2011-84729
Patent Literature 9: WO 2017/138464 A

SUMMARY OF INVENTION

Technical Problem

In recent years, there has been a demand for further improvement in corrosion resistance for application of a coated and plated steel sheet, which has a plating layer containing zinc, or the like, to home electric appliances, building materials, or the like. There is a demand for further improvement in corrosion resistance, particularly, further suppression of white rust in a processed portion, against cracks generated in a plating layer or a coating film by a processed portion (a processed portion by bending, pressing, or the like) of a zinc-based plated steel sheet or the like containing aluminum, magnesium, or the like.

In particular, the technique of Patent Literature 9 is a technique for a chromate-free post-treatment of an aluminum material, and is not a technique for a chromate-free post-treatment of a plated steel sheet having a plating layer containing zinc.

Therefore, there is a demand for a coated and plated steel sheet or coated and plated steel strip having a plating layer containing zinc that satisfies these performances.

Therefore, an object of the disclosure is to provide a chromate-free coated and plated steel sheet or coated and plated steel strip also having high corrosion resistance while suppressing the generation of white rust even when cracks are generated in a plating layer or a coating film by bending, pressing, or the like without using hexavalent chromium.

Solution to Problem

Means for solving the problem includes the following aspects.

<1> A coated and plated steel sheet or coated and plated steel strip including:

a steel sheet or a steel strip;

a plating layer provided on one surface or both surfaces of the steel sheet or steel strip and containing zinc;

a chemical conversion coating provided on the plating layer provided on one surface of the steel sheet or steel strip or provided on at least one of plating layers provided on both surfaces of the steel sheet or steel strip; and a single-layer coating film or multilayer coating film provided on the chemical conversion coating, wherein the single-layer coating film provided on the chemical conversion coating or a coating film, of the multilayer coating film, which is in contact with the chemical conversion coating, contains from 0.01 to 10.0% by mass of a cerium compound capable of being dissolved in an amount of 0.10 g or more with respect to 100 g of water at room temperature, with respect to a solid content of the single-layer coating film provided on the chemical conversion coating or the coating film, of the multilayer coating film, which is in contact with the chemical conversion coating.

<2> The coated and plated steel sheet or coated and plated steel strip according to <1>, wherein the cerium compound includes a cerium(III) compound.

<3> The coated and plated steel sheet or coated and plated steel strip according to <1>, wherein the cerium compound includes a cerium(IV) compound.

<4> The coated and plated steel sheet or coated and plated steel strip according to <3>, wherein the cerium(IV) compound includes diammonium cerium(IV) nitrate.

<5> The coated and plated steel sheet or coated and plated steel strip according to any one of <1> to <4>, wherein in the single-layer coating film provided on the chemical conversion coating or the coating film, of the multilayer coating film, which is in contact with the chemical conversion coating, a content of cerium chloride is 0.01% by mass or less with respect to a solid content of the single-layer coating film provided on the chemical conversion coating or the coating film, of the multilayer coating film, which is in contact with the chemical conversion coating.

<6> The coated and plated steel sheet or coated and plated steel strip according to any one of <1> to <5>, wherein the plating layer has a chemical composition consisting of, by mass %, Al: from 0 to 60.0%,
Mg: from 0 to 15.0%,
Si: from 0 to 2.0%,
Ni: from 0 to 1.0%,
Cr: from 0 to 1.0%,
Ti: from 0 to 1.0%, and
balance: Zn and impurities.

<7> The coated and plated steel sheet or coated and plated steel strip according to any one of <1> to <5>, wherein the plating layer has a chemical composition consisting of, by mass %, Al: from 0.5 to 60.0%,
Mg: from 0.5 to 15.0%,
Si: from 0 to 2.0%,
Ni: from 0 to 1.0%,
Cr: from 0 to 1.0%,
Ti: from 0 to 1.0%, and
balance: Zn and impurities.

<8> The coated and plated steel sheet or coated and plated steel strip according to any one of <1> to <7>, wherein a film thickness of the single-layer coating film provided on the chemical conversion coating or the coating film, of the multilayer coating film, which is in contact with the chemical conversion coating, is more than 5 μm.

<9> The coated and plated steel sheet or coated and plated steel strip according to any one of <1> to <8>, wherein the single-layer coating film provided on the chemical conversion coating or the coating film, of the multilayer coating film, which is in contact with the chemical conversion coating contains one or more of a polyester resin, an epoxy resin, an acrylic resin, or a urethane resin.

<10> The coated and plated steel sheet or coated and plated steel strip according to any one of <1> to <9>, wherein the single-layer coating film provided on the chemical conversion coating or the coating film, of the multilayer coating film, which is in contact with the chemical conversion coating contains one or more of vanadate, tungstate, silicate, or phosphate.

Advantageous Effects of Invention

According to the disclosure, it is possible to provide a chromate-free coated and plated steel sheet or coated and plated steel strip also having high corrosion resistance while suppressing the generation of white rust even when cracks are generated in a plating layer or a coating film by bending, pressing, or the like without using harmful hexavalent chromium.

DESCRIPTION OF EMBODIMENTS

Hereinafter, examples of a coated and plated steel sheet and a coated and plated steel strip of the disclosure will be described.

In the present specification, a numerical range that has been indicated by use of "to" means a range that includes the numerical values which are described before and after "to", as a lower limit value and an upper limit value, respectively, when "more than" or "less than" is not added to these numerical values. A numerical range when "more than" or "less than" is attached to the numerical values which are described before and after "to" means a range not including these numerical values as the lower limit value or the upper limit value.

In a numerical range described in a stepwise manner in the present specification, an upper limit value in a certain stepwise numerical range may be replaced with an upper limit value in another numerical range described in a stepwise manner, or may be replaced with a value shown in Examples. A lower limit value in a certain stepwise numerical range may be replaced with a lower limit value in another numerical range described in a stepwise manner, or may be replaced with a value shown in Examples.

As for the concentration or content, "%" means "% by mass".

"0 to" as the concentration or content (%) means that the component is an optional component and is not necessarily contained.

In the present specification, a "layer containing only zinc as a plating component" is also referred to as a "zinc plating layer", a "plating layer containing aluminum, magnesium, or the like in addition to zinc, as a plating component" is also referred to as a "zinc alloy plating layer", and the "zinc plating layer", the "zinc alloy plating layer", and the "plating layer containing zinc" are also collectively referred to as a "zinc-based plating layer".

A "steel sheet having a zinc plating layer" is also referred to as a "zinc plated steel sheet", a "steel sheet having a zinc alloy plating layer" is also referred to as a "zinc alloy plated steel sheet", and a "steel sheet having a zinc-based plating layer" is also referred to as a "zinc-based plated steel sheet".

A coated and plated steel sheet or coated and plated steel strip of the disclosure includes:

- a steel sheet or a steel strip;
- a plating layer provided on one surface or both surfaces of the steel sheet or steel strip and containing zinc;
- a chemical conversion coating provided on the plating layer provided on one surface of the steel sheet or steel strip or provided on at least one of the plating layers provided on both surfaces of the steel sheet or steel strip; and
- a single-layer coating film or multilayer coating film provided on the chemical conversion coating.

In the coated and plated steel sheet of the disclosure, the single-layer coating film in contact with the chemical conversion coating or the coating film, of the multilayer coating film. which is in contact with the chemical conversion coating (hereinafter, "the single-layer coating film in contact with the chemical conversion coating or the coating film, of the multilayer coating film, which is in contact with the chemical conversion coating" is also simply referred to as the "coating film in contact with the chemical conversion coating") contains a cerium compound capable of being dissolved in an amount of 0.10 g or more with respect to 100 g of water at room temperature at a concentration of from 0.01 to 10.0% by mass, with respect to a solid content of the coating film in contact with the chemical conversion coating.

With the above configuration, the coated and plated steel sheet or coated and plated steel strip of the disclosure is a chromate-free coated and plated steel sheet or coated and plated steel strip also having high corrosion resistance while suppressing the generation of white rust even when cracks are generated in a plating layer or a coating film by bending, pressing, or the like without using harmful hexavalent chromium.

The coated and plated steel sheet or coated and plated steel strip of the disclosure has been found from the following findings.

In the chromate-free coated and plated steel sheet, an interface at which corrosion occurs is any one of an interface between the plating layer and the chemical conversion coating or an interface between the plating layer and the coating film in contact with the chemical conversion coating. However, the chemical conversion coating is in the order of several tens to several hundreds of nanometers, which is smaller than the coating film in contact with the chemical conversion coating, and the interface cannot be clearly specified by cross-sectional observation with a scanning electron microscope. Since the thickness of the generated corrosion product is thicker than the thickness of the chemical conversion coating, it is not possible to specify at which interface the corrosion product is formed. Therefore, unless otherwise specified, a portion where corrosion occurs is between the plating layer and the coating film in contact with the chemical conversion coating. That is, the corrosion product formed at each interface is referred to as a corrosion product formed between the plating layer and the coating film in contact with the chemical conversion coating.

Although the chemical conversion coating is formed between the plating layer and the coating film in contact with the chemical conversion coating, the chemical conversion coating usually has a film thickness in the order of nanometers, and when unevenness in film thickness or the like occurs, the plating layer and the coating film in contact with the chemical conversion coating may be in direct contact with each other, so that a corrosion product may also be formed at an interface between the plating layer and the coating film in contact with the chemical conversion coating.

First, the present inventors have conducted the following studies in order to clarify the reason why white rust is likely to be generated when bending, pressing, or the like is performed.

For a coated and plated steel sheet subjected to a general chromate-free chemical conversion treatment and coating and a coated and plated steel sheet subjected to a chromate chemical conversion treatment and coating, a corrosion promotion test was performed by a combined cycle test on the coated and plated steel sheet subjected to bending, and cross-sectional observation after the corrosion test was performed. As a result, the present inventors have obtained the following knowledge.

When a general chromate-free chemical conversion treatment is performed, there is a difference in the corrosion behavior of a processed portion between a coated and plated steel sheet obtained by using a zinc plated steel sheet having a zinc plating layer as an original sheet (hereinafter, "coated zinc plated steel sheet") and a coated and plated steel sheet obtained by using a zinc alloy plated steel sheet having a zinc alloy plating layer containing aluminum, magnesium, or the like as an original sheet (hereinafter, "coated zinc alloy plated steel sheet").

In the coated zinc plated steel sheet, the behavior was such that the entire zinc plating layer corroded from a crack portion generated in the bent portion. On the other hand, in the coated zinc alloy plated steel sheet, corrosion also proceeds between the plating layer and the coating film in contact with the chemical conversion coating, starting from the crack portion of the plating layer generated by bending. This was presumed to be because the zinc alloy plating layer contained aluminum, magnesium, or the like having higher oxidizability than zinc, so that the ability to elute a plating component or form a protective corrosion product was higher than that of the zinc plating layer, and the elution of the plating component from the crack portion to the inside of the plating layer through a specific plating layer having high oxidizability existing between the plating layer and the coating film in contact with the chemical conversion coating or the oxidation due to the formation of a corrosion product proceeded, leading to the generation of white rust.

On the other hand, with respect to the coated and plated steel sheet subjected to the chemical conversion treatment containing chromate and coating, corrosion hardly proceeded between the plating layer and the coating film in contact with the chemical conversion coating starting from the crack portion of the plating layer or the coating film caused by bending without depending on a steel sheet having a zinc plating layer or a zinc alloy plating layer containing aluminum, magnesium, or the like, and the generation of white rust was also small. The reason for this is as follows. In the chromate chemical conversion treatment, the chemical conversion coating has high oxidizing ability and high affinity between a metal constituting the plating layer or the oxide thereof and the chemical conversion coating, so that the chemical conversion coating can quickly and firmly form a bond with the surface of the plating layer, and this is effective for corrosion resistance of a processed portion.

Since chromate has plural valences, it is considered that the fact that the chromate has an oxidizing action on the steel sheet and can self-repair the film is a factor of exhibiting high corrosion resistance of the processed portion.

Attention has been paid to Ce having plural valences similarly to chromate and having high affinity with constituent components of the zinc-based plated steel sheet. In particular, attention has been paid to a cerium compound capable of being dissolved in an amount of 0.10 g or more with respect to 100 g of water at room temperature (hereinafter, also simply referred to as a "specific cerium compound"). This is because when the specific cerium compound is contained in the coating film in contact with the chemical conversion coating, cerium ions in the coating film are eluted from the coating film under a corrosive environment onto plating or a steel sheet, and the specific cerium compound has a property of suppressing a corrosion reaction.

As a result of adding the specific cerium compound to the coating film in contact with the chemical conversion coating, the generation of white rust on the bent portion after a combined cycle corrosion test (CCT) was suppressed. Therefore, the specific cerium compound was found to be an effective inhibitor for the zinc-based plating layer.

One of the reasons for the decrease in the corrosion resistance of the processed portion is considered to be excessive elution of the plating component from the cracked part of the plating layer, but it is presumed that the cerium ions contained in the specific cerium compound suppressed the elution of the plating component.

By adding the specific cerium compound to the coating film in contact with the chemical conversion coating, as compared with a case in which the specific cerium compound is added to the chemical conversion coating, a coated and plated steel sheet having high corrosion resistance is obtained while suppressing the generation of white rust even when cracks occur in the plating layer or the coating film due to bending, pressing, or the like. The reason is presumed as follows.

By adding the specific cerium compound to the coating film in contact with the chemical conversion coating, cerium ions are eluted from the coating film in a corrosive environment to oxidize the surface of plating or steel, so that corrosion resistance of plating is enhanced to suppress excessive elution, and a region where an anode reaction or a cathode reaction, which is an elementary reaction of plating or steel corrosion, occurs is protected.

The same applies to the coated and plated steel strip.

From the above findings, it was found that, with the above configuration, the coated and plated steel sheet or coated and plated steel strip of the disclosure is a chromate-free coated and plated steel sheet or coated and plated steel strip also having high corrosion resistance while suppressing the generation of white rust even when cracks are generated in a plating layer or a coating film by bending, pressing, or the like without using harmful hexavalent chromium.

Hereinafter, the coated and plated steel sheet of the disclosure will be specifically described.

<Steel Sheet>

The steel sheet is a steel sheet on which a plating layer is to be formed. The steel sheet is not particularly limited. As the steel sheet, for example, any type of steel sheets such as an ultra-low C type (a ferrite base structure), an Al-k type (a structure containing pearlite in ferrite), a two-phase structure type (for example, a structure containing martensite in ferrite and a structure containing bainite in ferrite), a strain induced transformation type (a structure containing retained austenite in ferrite), and a fine crystal type (a ferrite base structure) may be used.

The tensile strength of the steel sheet is not particularly limited, but is preferably from 270 to 780 MPa, more preferably from 270 to 590 MPa, and still more preferably from 270 to 440 MPa.

The tensile strength is measured in accordance with JIS Z 2241:2011 using a No. 5 test piece of JIS Z 2241:2011. A collection place of a tensile test piece may be a portion of ¼ from the end in the plate width direction, and a direction perpendicular to a rolling direction may be taken as a longitudinal direction.

The sheet thickness of the steel sheet is not particularly limited, but is preferably from 0.20 to 2.0 mm, more preferably from 0.25 to 1.2 mm, and still more preferably from 0.30 to 1.0 mm.

<Zinc-Based Plated Layer>

The content of zinc in the zinc-based plating layer (plating layer containing zinc) is preferably from 25.0 to 100.0% by mass with respect to the entire chemical composition of the zinc-based plating layer. If necessary, the lower limit of the content of zinc may be 30.0% by mass, 35.0% by mass, 45.0% by mass, 55.0% by mass, or 65.0% by mass. Specific examples of the zinc-based plating layer include a zinc plating layer, a zinc-aluminum-magnesium plating layer, a zinc-aluminum-magnesium-silicon plating layer, a zinc-aluminum plating layer, and a zinc-aluminum-silicon plating layer.

Examples of the zinc-based plating layer also include plating layers containing, as a dissimilar metal element or impurity, a small amount of cobalt, molybdenum, tungsten, nickel, titanium, chromium, aluminum, manganese, iron, magnesium, lead, bismuth, antimony, tin, copper, cadmium, arsenic, or the like.

In particular, the zinc-based plating layer is preferably a plating layer containing aluminum and a plating layer containing aluminum and magnesium in addition to zinc from the viewpoint of corrosion resistance. That is, when a zinc alloy plated steel sheet is used as an original sheet, corrosion resistance superior to that of the zinc plated steel sheet can be obtained, which is preferable.

More specifically, in zinc-based plating layer, the plating layer preferably has a chemical composition consisting of, by mass %, Al: from 0 to 60.0%,
Mg: from 0 to 15.0%,
Si: from 0 to 2.0%,
Ni: from 0 to 1.0%,
Cr: from 0 to 1.0%,
Ti: from 0 to 1.0%, and
balance: Zn and impurities.

When the steel sheet having the zinc-based plating layer with the above composition is subjected to bending, pressing, or the like to generate cracks in the plating layer or the coating film, white rust and corrosion may occur. However, by providing a chemical conversion coating on the plating layer and a single-layer or multilayer coating film provided on the chemical conversion coating and containing a specific cerium compound at the above concentration, generation of white rust is suppressed, and corrosion resistance is also improved.

Specifically, the zinc-based plating layer is preferably a plating layer containing from 0.5 to 60.0% by mass of aluminum with the balance being zinc and impurities, and more preferably a plating layer containing from 0.5 to 60.0% by mass of aluminum and further containing from 0.5 to 15.0% by mass or less of magnesium with the balance being zinc and impurities. At this time, the zinc-based plating layer may contain 1.0% by mass or less of Si, Ni, Cr, or Ti. The content of Al, Mg, Si, Ni, Cr, or Ti is not essential, and the lower limit thereof is 0%.

The lower limit of Al content is preferably 1.0% by mass, 1.5% by mass, or 2.0% by mass.

The upper limit of Al content is preferably 55.0% by mass, 50.0% by mass, or 45.0% by mass.

The lower limit of Mg content is preferably 1.0% by mass, 1.5% by mass, or 2.0% by mass.

The upper limit of Mg content is preferably 12.5% by mass, 10.0% by mass, or 7.5% by mass.

The lower limit of Si content is preferably 0.2% by mass, 0.4% by mass, or 0.6% by mass.

The upper limit of Si content is preferably 1.8% by mass, 1.6% by mass, or 1.4% by mass.

The lower limit of each of Ni content, Cr content, and Ti content is preferably 0.1% by mass, 0.2% by mass, or 0.3% by mass.

The upper limit of each of Ni content, Cr content, and Ti content is preferably 0.8% by mass, 0.6% by mass, or 0.4% by mass.

Examples of the zinc alloy plating layer containing all of zinc, aluminum, and magnesium include a zinc-aluminum-magnesium plating layer and a zinc-aluminum-magnesium-silicon plating layer, and depending on the ratio of each component, there are various plating layers such as a Zn-6% Al-3% Mg plating layer, a Zn-11% Al-3% Mg-0.2% Si plating layer, a Zn-55% Al-2% Mg-1.6% Si plating layer, and a plating layer containing a trace amount of Ni, Cr, Ti, or the like in these plating layers.

Specifically, in zinc-based plating layer, the plating layer may have a chemical composition consisting of, by mass %, Al: from 0.5 to 60.0%,
Mg: from 0.5 to 15.0%,
Si: from 0 to 2.0%,
Ni: from 0 to 1.0%,
Cr: from 0 to 1.0%,
Ti: from 0 to 1.0%, and
balance: Zn and impurities. That is, the zinc-based plating layer may be a zinc alloy plating layer.

The method of forming the zinc-based plating layer is not particularly limited, and may be any of known methods such as an electroplating method, a hot-dip plating method, a vapor deposition plating method, a dispersion plating method, and a vacuum plating method.

The adhesion amount of the zinc-based plating layer per one surface of the steel sheet is not particularly limited, but is preferably from 15 $g \cdot m^{-2}$ to 140 $g \cdot m^{-2}$. The adhesion amount is more preferably from 30 $g \cdot m^{-2}$ to 90 $g \cdot m^{-2}$.

When the adhesion amount of the zinc-based plating layer is 15 $g \cdot m^{-2}$ or more, generation of a non-plated portion is suppressed, and the anticorrosion effect by plating is improved. When the adhesion amount of the zinc-based plating layer is 140 $g \cdot m^{-2}$ or less, corrosion resistance is improved, and a phenomenon that plating is blackened hardly occurs.

<Chemical Conversion Coating (Hereinafter, Also Referred to as "Coating")>

The chemical conversion coating is formed by a chemical conversion treatment after impurities such as oil and surface oxides adhering to the surface of the plated steel sheet are removed in a degreasing step and a cleaning step.

The chemical conversion coating may contain any one or more selected from a resin, a silane coupling agent, a zirconium compound, silica, phosphoric acid and a salt thereof, a fluoride, or a vanadium compound. When these substances are contained, the film formability after application of a chemical conversion treatment solution, barrier properties (denseness) of the coating against corrosion factors such as moisture and corrosive ions, coating adhesion to the plated surface, and the like are further improved, which contributes to raising the level of corrosion resistance of the coating.

In particular, when the chemical conversion coating contains any one or more of a silane coupling agent or a zirconium compound, since a crosslinked structure is formed in the coating and bonding with a plated surface is further strengthened, so that adhesion and barrier properties of the coating can be enhanced.

When the chemical conversion coating contains any one or more of silica, phosphoric acid and a salt thereof, a fluoride, or a vanadium compound, corrosion resistance can be improved by forming a precipitate coating or a passive coating on the surface of plating or steel as an inhibitor.

The chemical conversion film may contain a specific cerium compound.

[Resin]

The resin is not particularly limited, and for example, a known organic resin such as a polyester resin, a polyurethane resin, an epoxy resin, a phenol resin, an acrylic resin, or a polyolefin resin can be used. In order to further enhance the adhesion to the plated steel sheet, it is preferable to use at least one of resins (such as a polyester resin, a urethane resin, an epoxy resin, and an acrylic resin) having a forced site or a polar functional group in the molecular chain. The resin may be used singly or in combination with two or more kinds thereof.

The content (dry film concentration=% by mass with respect to the solid content of the chemical conversion film) of the resin is preferably from 0% by mass to 85% by mass with respect to the coating solid content. The content is more preferably from 0% by mass to 60% by mass and more preferably from 1% by mass to 40% by mass. When the content of the resin is more than 85% by mass, the ratio of other coating constituent components decreases, and the performance required as a coating other than corrosion resistance may deteriorate.

[Silane Coupling Agent]

The silane coupling agent is a compound other than the above-described carboxylic acid derivative having a silanol group, and various silane compounds can be used.

Examples of the silane coupling agent include γ-(2-aminoethyl)aminopropyltrimethoxysilane, γ-(2-aminoethyl)aminopropylmethyldimethoxysilane, γ-(2-aminoethyl)aminopropyltriethoxysilane, γ-(2-aminoethyl)aminopropylmethyldiethoxysilane, γ-(2-aminoethyl)aminopropylmethyldimethoxysilane, γ-methacryloxypropyltrimethoxysilane, γ-methacryloxypropylmethyldimethoxysilane, γ-methacryloxypropyltriethoxysilane, γ-methacryloxypropylmethyldiethoxysilane, N-β-(N-vinylbenzylaminoethyl)-γ-aminopropyltrimethoxysilane, N-β-(N-vinylbenzylaminoethyl)-γ-aminopropylmethyldimethoxysilane, N-β-(N-vinylbenzylaminoethyl)-γ-aminopropyltriethoxysilane, N-β-(N-vinylbenzylaminoethyl)-γ-aminopropylmethyldiethoxysilane, γ-glycidoxypropyltrimethoxysilane, γ-glycidoxypropylmethyldimethoxysilane, γ-glycidoxypropyltriethoxysilane, γ-glycidoxypropylmethyldiethoxysilane, γ-mercaptopropyltrimethoxysilane, γ-mercaptopropylmethyldimethoxysilane, γ-mercaptopropyltriethoxysilane, γ-mercaptopropylmethyldiethoxysilane, methyltrimethoxysilane, dimethyldimethoxysilane, methyltriethoxysilane, dimethyldiethoxysilane, vinyltriacetoxysilane, γ-chloropropyltrimethoxysilane, γ-chloropropylmethyldimethoxysilane, γ-chloropropyltriethoxysilane, γ-chloropropylmethyldiethoxysilane, hexamethyldisilazane, γ-anilinopropyltrimethoxysilane, γ-anilinopropylmethyldimethoxysilane, γ-anilinopropyltriethoxysilane, γ-anilinopropylmethyldiethoxysilane, vinyltrimethoxysilane, vinylmethyldimethoxysilane, vinyltriethoxysilane, vinylmethyldiethoxysilane, octadecyldimethyl[3-(trimethoxysilyl)propyl]ammonium chloride, octadecyldimethyl[3-(methyldimethoxysilyl)propyl]ammonium chloride, octadecyldimethyl[3-(triethoxysilyl)propyl]ammonium chloride, octadecyldimethyl[3-(methyldiethoxysilyl)propyl]ammonium chloride, γ-chloropropylmethyldimethoxysilane, γ-mercaptopropylmethyldimethoxysilane, methyltrichlorosilane, dimethyldichlorosilane, and trimethylchlorosilane.

Among them, when a silane coupling agent having a glycidyl ether group (for example, γ-glycidoxypropyltrimethoxysilane, γ-glycidoxypropyltriethoxysilane, or the like having a glycidyl ether group) is used as the silane coupling agent, the processing adhesion of the coating film (lower layer coating film) in contact with the chemical conversion coating is particularly improved. When a triethoxy-type silane coupling agent is used, the storage of a base treatment agent can be improved. This is considered to be because triethoxysilane is relatively stable in an aqueous solution and has a low polymerization rate.

The silane coupling agent may be used singly or in combination with two or more kinds thereof.

[Zirconium Compound]

The zirconium compound is not particularly limited, and examples thereof include zirconium normal propylate, zirconium normal butyrate, zirconium tetraacetylacetonate, zirconium monoacetylacetonate, zirconium bisacetylacetonate, zirconium monoethylacetoacetate, zirconium acetylacetonate bisethylacetoacetate, zirconium acetate, zirconium monostearate, zirconium carbonate, ammonium zirconium carbonate, potassium zirconium carbonate, and sodium zirconium carbonate.

The zirconium compound may be used singly or in combination with two or more kinds thereof.

A zirconium carbonate compound undergoes a crosslinking reaction with a resin to form a coating having a crosslinked structure of zirconium and the resin. When the zirconium carbonate compound is applied and dried, carbonate ions are volatilized, and the remaining zirconium is bonded to each other via oxygen to increase a molecular weight. In this process, the —Zr—OH group forms a Zr—O-M bond (M: metal element in the plating layer) with the surface of the plating layer.

[Total Content of Silane Coupling Agent and Zirconium Compound]

The content (dry film concentration=% by mass with respect to the solid content of the chemical conversion film) of the silane coupling agent and zirconyl salt is preferably from 5% by mass to 80% by mass in the coating. The content is more preferably from 20% by mass to 70% by mass. When the content is less than 5% by mass, the effect of improving adhesion to the substrate and corrosion resistance cannot be obtained in some cases, and when the content is more than 80% by mass, processability may be deteriorated.

[Silica]

Silica is a generic term for silica that can stably maintain a water-dispersed state when dispersed in water because of having a fine particle size. Silica is effective for improving corrosion resistance of a coated and plated steel sheet and improving adhesion of a coating film (lower layer coating film) in contact with a chemical conversion coating.

The silica is not particularly limited, but for example, silica fine particles such as colloidal silica and fumed silica having a primary particle diameter of from 5 to 50 nm are preferable. As the silica, for example, commercially available silica gel such as "SNOWTEX N", "SNOWTEX C", "SNOWTEX UP", and "SNOWTEX PS" (all manufactured by Nissan Chemical Corporation), and "ADELITE AT-20Q" (manufactured by ADEKA CORPORATION), powder silica such as AEROSIL #300 (manufactured by Nippon Aerosil Co., Ltd.), or the like can be used. The silica may be appropriately selected according to required performance.

The silica may be used singly or in combination with two or more kinds thereof.

The content (dry film concentration=% by mass with respect to the solid content of the chemical conversion film) of the silica is preferably from 0% by mass to 30% by mass with respect to the coating solid content. The content is more preferably from 1% by mass to 20% by mass. When the content of the silica is more than 30% by mass, the coating becomes brittle, and the processing followability at the time of molding the coated and plated steel sheet may be deteriorated.

[Phosphoric Acid and Salt Thereof]

Examples of the phosphoric acid and the salt thereof include phosphoric acids such as orthophosphoric acid, metaphosphoric acid, pyrophosphoric acid, triphosphoric acid, and tetraphosphoric acid, and salts thereof, ammonium salts such as triammonium phosphate and diammonium hydrogen phosphate; phosphonic acids such as amino tri (methylene phosphonic acid), 1-hydroxyethylidene-1,1-diphosphonic acid, ethylenediamine tetra(methylene phosphonic acid), and diethylenetriamine penta(methylene phosphonic acid), and salts thereof; and organic phosphoric acids such as phytic acid and salts thereof. Examples of the salt of phosphoric acid other than the ammonium salt include metal salts with Na, Mg, Al, K, Ca, Mn, Ni, Zn, Fe, and the like.

The phosphoric acid and the salt thereof may be used singly or in combination with two or more kinds thereof.

The content (dry film concentration=% by mass with respect to the solid content of the chemical conversion film) of the phosphoric acid and the salt thereof is preferably from 0% by mass to 20% by mass with respect to the coating solid content. The content is more preferably from 1% by mass to 10% by mass.

When the content of the phosphoric acid and the salt thereof is more than 20% by mass, the coating becomes brittle, and the processing followability of the coating at the time of molding the coated and plated steel sheet may be deteriorated.

[Fluoride]

Examples of the fluoride include fluorozirconate, ammonium fluorosilicate, ammonium fluorotitanate, sodium fluoride, potassium fluoride, calcium fluoride, lithium fluoride, hexafluorotitanic acid, and hexafluorozirconic acid.

The fluoride may be used singly or in combination with two or more kinds thereof.

The content (dry film concentration=% by mass with respect to the solid content of the chemical conversion film) of the fluoride is preferably from 0% by mass to 20% by mass with respect to the coating solid content. The content is more preferably from 1% by mass to 10% by mass. When the content of the fluoride is more than 20% by mass, the coating becomes brittle, and the processing followability of the coating at the time of molding the coated and plated steel sheet may be deteriorated.

[Vanadium Compound]

Examples of the vanadium compound include vanadium compounds obtained by reducing pentavalent vanadium compounds, such as vanadium pentoxide, metavanadic acid, ammonium metavanadate, sodium metavanadate, and vanadium oxytrichloride, to have bi- to tetravalence with a reducing agent; and vanadium compounds whose oxidation number is tetra- to bivalence such as vanadium trioxide, vanadium dioxide, vanadium oxysulfate, vanadium oxyoxalate, vanadium oxyacetylacetonate, vanadium acetylacetonate, vanadium trichloride, phosphovanadomolybdic acid, vanadium sulfate, vanadium dichloride, and vanadium oxide.

The vanadium compound may be used singly or in combination with two or more kinds thereof.

The content (dry film concentration=% by mass with respect to the solid content of the chemical conversion film) of the vanadium compound is preferably from 0% by mass to 20% by mass with respect to the coating solid content. The content is more preferably from 1% by mass to 10% by mass. When the content of the vanadium compound is more than 20% by mass, the coating becomes brittle, and the processing followability of the coating at the time of molding the coated and plated steel sheet may be deteriorated.

The specific cerium compound may also be contained in the chemical conversion coating.

Examples of the specific cerium compound contained in the chemical conversion coating include the same compounds as a specific cerium compound contained in the coating film described below. That is, a cerium compound capable of being dissolved in an amount of 0.10 g or more with respect to 100 g of water at room temperature is exemplified.

The lower limit of the content of the specific cerium compound contained in the chemical conversion coating is preferably 0.01% by mass, more preferably 0.5% by mass, and still more preferably 1.0% by mass, with respect to the solid content of the coating film in contact with the chemical conversion coating.

The upper limit of the content of the specific cerium compound is preferably 10.0% by mass, more preferably 8.0% by mass, and still more preferably 5.0% by mass, with respect to the solid content of the coating film in contact with the chemical conversion coating.

[Specific Example of Composition of Chemical Conversion Coating]

Specific examples of the composition of the chemical conversion coating will be described.

As an example of the composition of the chemical conversion coating, it is preferable to contain any one of a resin, a silane coupling agent, or a zirconium compound.

In this case, the content of the resin is preferably from 40 to 85% by mass, more preferably from 45 to 80% by mass, and still more preferably from 50 to 75% by mass, with respect to the coating solid content.

The content of the silane coupling agent or the zirconium compound is preferably from 15 to 60% by mass, more preferably from 20 to 55% by mass, and still more preferably from 25 to 50% by mass, with respect to the coating solid content.

As another example of the composition of the chemical conversion coating, a composition containing the following components is preferable.

Resin

Any one of silane coupling agent or zirconium compound

Any one or more of silica, phosphoric acid, salt thereof, fluoride, or vanadium compound In this case, the content of the resin is preferably from 10 to 75% by mass, more preferably from 15 to 70% by mass, and still more preferably from 20 to 65% by mass, with respect to the coating solid content.

The content of the silane coupling agent or the zirconium compound is preferably from 5 to 59% by mass, more preferably from 12 to 53% by mass, and still more preferably from 18 to 47% by mass, with respect to the coating solid content.

The total content of the silica, the phosphoric acid and the salt thereof, the fluoride, and the vanadium compound is preferably from 1 to 40% by mass, more preferably from 2 to 30% by mass, still more preferably from 3 to 20% by mass, with respect to the coating solid content.

[Method of Forming Chemical Conversion Agent]

The method of producing a chemical conversion agent is not particularly limited, and examples thereof include a method in which each coating forming component is mixed, stirred with a disper, and dissolved or dispersed. In order to improve the solubility or dispersibility of each coating forming component, known hydrophilic solvent or the like may be added if necessary. An acid, an alkali, or the like may be added to the chemical conversion agent for pH adjustment within a range in which its performance is not impaired.

In order to form a chemical conversion coating, a chemical conversion agent is applied to a plated steel sheet, and the coating film is heated and dried.

The method of applying the chemical conversion agent is not particularly limited, and generally known coating methods such as roll coating, air spraying, airless spraying, and immersion can be used.

The heating and drying temperature may be from 50 to 250° C. When the temperature is less than 50° C., the evaporation rate of moisture is low, and sufficient film-forming properties cannot be obtained, so that the anticorrosion performance may be insufficient. When the temperature is more than 250° C., the alkyl moiety of the silane coupling agent, which is an organic substance, may be modified due to thermal decomposition or the like, leading to deterioration of adhesion and corrosion resistance. The heating temperature is more preferably from 70 to 160° C.

The heating and drying method is not particularly limited, and examples thereof include a method in which hot air, induction heating, near infrared rays, direct flame, or the like is used singly or in combination. For example, in the case of using hot air drying, the heating and drying time is preferably from 1 second to 5 minutes.

[Adhesion Amount of Chemical Conversion Coating Per One Surface of Plated Steel Sheet]

The adhesion amount of the chemical conversion coating per one surface of the plated steel sheet is preferably from 10 to 1000 mg/m$^2$ in terms of solid content. When the adhesion amount is less than 10 mg/m$^2$, sufficient processing adhesion and corrosion resistance are not secured, and when the adhesion amount is more than 1000 mg/m$^2$, the processing adhesion may be deteriorated.

The lower limit of the adhesion amount of the chemical conversion coating per one surface of the plated steel sheet is more preferably 20 mg/m$^2$ or 30 mg/m$^2$ and still more preferably 40 mg/m$^2$ or 50 mg/m$^2$. The upper limit of the adhesion amount of the chemical conversion coating per one surface of the plated steel sheet is more preferably 800 mg/m$^2$ or 600 mg/m$^2$ and still more preferably 400 mg/m$^2$, 300 mg/m$^2$, or 200 mg/m$^2$. The film thickness of the chemical conversion coating per one surface of the plated steel sheet is preferably 2.0 μm or less and preferably 1.0 μm or less, 0.8 μm or less, or 0.6 μm or less. The lower limit of the film thickness of the chemical conversion coating per one surface of the plated steel sheet does not need to be particularly determined, but may be 0.01 μm, 0.03 μm, or 0.05 μm.

<Coating Film>

The coating film is a single-layer or multilayer film to be formed on the chemical conversion coating. The coating film is often provided in one to three layers per one surface of the coated and plated steel sheet. When the coating film has two or more layers, the coating film in contact with the chemical conversion coating is also sometimes particularly referred to as a primer coating film, and is often intended to ensure adhesion between the coating film and the chemical conversion coating and corrosion resistance. The coating film of the upper layer is often intended to ensure designability by coloring, barrier properties, and other surface functionalities. The coating film described herein indicates a coating film in contact with the chemical conversion coating unless otherwise specified.

The coating film contains a specific cerium compound.

The coating film contains, for example, a resin. The coating film preferably contains a pigment. In addition to these components, the coating film may contain additives such as a leveling agent, an antifoaming agent, a colorant, a viscosity modifier, and an ultraviolet absorber. A coating liquid for forming a coating film is preferably obtained by dispersing or dissolving each of the above components in a solvent.

[Specific Cerium Compound]

The specific cerium compound is a cerium compound capable of being dissolved in an amount of 0.10 g or more with respect to 100 g of water at room temperature.

The room temperature described herein refers to a temperature region of from 15 to 25° C.

Whether or not 0.10 g or more of the cerium compound can be dissolved with respect to 100 g of the solvent is determined by the following procedure.

First, 100 g of water is weighed. Subsequently, 0.10 g of a cerium compound to be measured is weighed. The weighed solvent and the cerium compound to be measured are added to a beaker, and the mixture is stirred while the temperature of the solvent is maintained at room temperature. Whether or not the cerium compound to be measured is dissolved is visually determined.

From the viewpoint of further suppressing the generation of white rust and further improving corrosion resistance, the specific cerium compound is preferably a specific cerium compound that is dissolved in an amount of 0.1 g or more, more preferably a specific cerium compound that is dissolved in an amount of 1.0 g or more, and still more preferably a specific cerium compound that is dissolved in an amount of 10 g or more, with respect to 100 g of water at room temperature.

Although not particularly limited, the specific cerium compound may be a specific cerium compound capable of being dissolved in an amount of 500 g or less with respect to 100 g of water at room temperature.

Examples of the specific cerium compound include a cerium(III) compound and a cerium(IV) compound. That is, the coating film in contact with the chemical conversion coating preferably contains at least one of a cerium(III) compound or a cerium(IV) compound as the specific cerium compound.

In particular, it is preferable to contain at least a cerium (IV) compound as the specific cerium compound. This is because the cerium(IV) compound has a higher effect of suppressing elution of a plating component than the cerium (III) compound.

Examples of the cerium(III) compound include cerium (III) nitrate hexahydrate (primary cerium nitrate hexahydrate), cerium(III) sulfate octahydrate (primary cerium sulfate octahydrate), cerium(III) sulfate tetrahydrate, bis (trifluoromethanesulfonyl)imide cerium(III), ammonium cerium(III) nitrate tetrahydrate, diammonium cerium(III) nitrate tetrahydrate, cerium(III) sulfate n-hydrate, cerium (III) bromide, cerium(III) chloride heptahydrate, cerium(III) chloride n-hydrate, cerium(III) acetate hydrate, cerium(III) trifluoromethanesulfonate, cerium(III) chloride, and cerium (III) iodide.

Among them, as the cerium(III) compound, cerium(III) nitrate hexahydrate (primary cerium nitrate hexahydrate), cerium(III) sulfate octahydrate (primary cerium sulfate octahydrate), ammonium cerium(III) nitrate tetrahydrate, diammonium cerium(III) nitrate tetrahydrate, cerium(III) sulfate n-hydrate, and cerium(III) acetate hydrate are preferable.

Examples of the cerium(IV) compound include diammonium cerium(IV) nitrate, cerium(IV) sulfate n-hydrate, tetraammonium cerium(IV) sulfate dihydrate, cerium(IV) sulfate anhydride, tetraammonium cerium(IV) sulfate tetrahydrate, and cerium(IV)-methoxyethoxide.

Among these, as the cerium(IV) compound, diammonium cerium(IV) nitrate, cerium(IV) sulfate n-hydrate, tetraammonium cerium(IV) sulfate dihydrate, cerium(IV) sulfate anhydride, and tetraammonium cerium(IV) sulfate tetrahydrate are preferable, and diammonium cerium(IV) nitrate is more preferable.

Examples of cerium compounds not corresponding to the specific cerium compound include a phosphate of cerium and an oxide of cerium.

The amount of the phosphate of cerium, the oxide of cerium, and the like dissolved in 100 g of water at room temperature is less than 0.10 g.

The content of the specific cerium compound is from 0.01 to 10.0% by mass with respect to the solid content of the coating film in contact with the chemical conversion coating.

When the content of the cerium compound is less than 0.01% by mass, the effect of suppressing elution of a plating component cannot be obtained, the generation of white rust cannot be suppressed, and corrosion resistance is deteriorated. Therefore, the content of the cerium compound is set to 0.01% by mass or more.

When the content of the cerium compound is more than 10.0% by mass, the concentration of the cerium compound in the coating film in contact with the chemical conversion coating is too high, so that the processability of the coating film in contact with the chemical conversion coating is deteriorated, and it may be difficult to sufficiently obtain performance other than corrosion resistance. Therefore, the content of the cerium compound is set to 10.0% by mass or less.

The lower limit of the content of the specific cerium compound is preferably 0.50% by mass, more preferably 1.0% by mass, and still more preferably 1.5% by mass, with respect to the solid content of the coating film in contact with the chemical conversion coating.

The upper limit of the content of the specific cerium compound is preferably 8.0% by mass, more preferably 5.0% by mass, and still more preferably 4.0% by mass, with respect to the solid content of the coating film in contact with the chemical conversion coating.

Cerium chloride tends to have a small effect on improvement of corrosion resistance in a processed portion. Although the reason is not clear, it is presumed that cerium chloride forms a complex salt with a metal such as iron to enhance solubility, and the lower the content of cerium chloride in the coating film in contact with the chemical conversion coating, the more advantageous.

Therefore, in the coating film in contact with the chemical conversion coating, the content of cerium chloride is preferably 0.01% by mass or less or less than 0.01% by mass, more preferably 0.005% by mass or less, and still more preferably 0.001% by mass or less, with respect to the solid content of the coating film in contact with the chemical conversion coating.

In the coating film in contact with the chemical conversion coating, the content of cerium chloride is preferably 0% by mass (that is, it is preferable that the coating film in contact with the chemical conversion coating does not contain cerium chloride), but may be 0.001% by mass or more with respect to the solid content of the coating film in contact with the chemical conversion coating.

Examples of the cerium chloride include cerium(III) chloride, cerium(III) chloride heptahydrate, and cerium(III) chloride n-hydrate.

[Resin]

The resin is not particularly limited. Examples thereof include a polyester resin, an acrylic resin, an epoxy resin, a urethane resin, and a fluororesin.

Examples of the resin also include resins obtained by crosslinking these resins with a butylated melamine resin, a methylated melamine resin, a butylmethyl-mixed melamine resin, a urea resin, an isocyanate resin, or a crosslinking agent component of a mixed system thereof.

Examples of the resin also include an electron beam curable resin and an ultraviolet curable resin.

Among them, as a binder resin, any one or more of a polyester resin, an epoxy resin, an acrylic resin, or a urethane resin are preferable.

These binder resins may be used singly or as a mixture of two or more thereof.

The content of the resin is preferably from 20 to 90% by mass with respect to the coating film solid content. When the content of the resin is less than 20% by mass, since there are few components to be a matrix, cracks and the like are likely to occur due to processing and the like, and corrosion resistance and the like may be affected. When the content of the resin is more than 90% by mass, since the content of a rust preventive pigment or the like is small, corrosion resistance and adhesion as a coating film cannot be secured in some cases. From the viewpoint of processability, corrosion resistance, and the like, the content of the resin is more preferably from 30 to 80% by mass.

[Pigment]

The pigment is roughly classified into a rust preventive pigment, a color pigment, and an extender pigment.

Examples of the rust preventive pigment include vanadate, tungstate, silicate, and phosphate.

Examples of the color pigment include known inorganic and organic color pigments.

Examples of the inorganic color pigment include titanium oxide, zinc oxide, zirconium oxide, calcium carbonate, barium sulfate, alumina, kaolin clay, carbon black, and iron oxide. Examples of the organic color pigment include hansa yellow, pyrazolone orange, phthalocyanine, and azo-based pigments.

Examples of the extender pigment include talc, clay, silica, mica, alumina, calcium carbonate, and barium sulfate.

Among them, a rust preventive pigment is preferable as the pigment from the viewpoint of improving corrosion resistance. That is, the coating film (lower layer coating film) in contact with the chemical conversion coating preferably contains any one or more of vanadate, tungstate, silicate, or phosphate.

Examples of the vanadate include calcium vanadate, magnesium vanadate, ammonium metavanadate, potassium vanadate, sodium vanadate, ammonium vanadate, phosphorus vanadate, and vanadium oxide.

Examples of the tungstate include sodium tungstate, calcium tungstate, ammonium tungstate, lithium tungstate, and magnesium tungstate.

Examples of the silicate include sodium silicate, potassium silicate, lithium silicate, and calcium ion-exchanged silica.

Examples of the phosphate include sodium dihydrogen phosphate, potassium dihydrogen phosphate, dipotassium hydrogen phosphate, sodium tripolyphosphate, aluminum tripolyphosphate, magnesium tripolyphosphate, sodium dihydrogen phosphate monohydrate, sodium dihydrogen phosphate dihydrate, and calcium hypophosphite.

The content of the pigment is preferably from 5 to 70% by mass with respect to the coating film solid content. When the content of the pigment is less than 5% by mass, the rigidity and cohesive force of the coating film are reduced, so that coating film peeling (coating film biting) may easily occur when the surface of the coating film is rubbed against a mold during pressing of a coated and plated steel sheet. When the content of the pigment is more than 70% by mass, processability may be deteriorated. From the viewpoint of the balance among corrosion resistance, chemical resistance, and processability, the content of the pigment is more preferably from 15 to 70% by mass and still more preferably from 20 to 50% by mass.

[Film Thickness of Coating Film]

The film thickness of the coating film is preferably 4 μm or more (for example, from 4 to 50 μm). The film thickness of the coating film means the total film thickness of multiple layers when the coating film has multiple layers.

However, when the coating film has multiple layers, the coating film (lower layer coating film) in contact with the chemical conversion coating is preferably from 4 to 15 μm. When the film thickness is 4 μm or more, sufficient corrosion resistance and chemical resistance can be easily obtained. On the other hand, when the film thickness is 15 μm or less, processability is easily improved. From the viewpoint of a favorable balance among corrosion resistance, chemical resistance, and processability, the film thickness of the coating film (lower layer coating film) in contact with the chemical conversion coating is more preferably in a range of from 4 to 10 μm.

When the coating film has multiple layers, the film thickness of the coating film on the upper layer of the coating film in contact with the chemical conversion coating is preferably from 5 to 30 μm. When the film thickness is 5 μm or more, chemical resistance, corrosion resistance, and color masking property are easily improved, and designability can be also easily obtained. When the film thickness is 30 μm or less, processability is easily improved. The thickness of the coating film of the upper layer is more preferably from 10 to 25 μm.

When the coating film of the upper layer has multiple layers, the film thickness of the coating film of the upper layer means the film thickness of each coating film of the upper layer.

When the coating film has a single layer or multilayer layers, from the viewpoint of further suppressing generation of white rust and further improving corrosion resistance, the film thickness of the coating film in contact with the chemical conversion coating is preferably more than 5 μm, more preferably 6 μm or more, and still more preferably 7 μm or more.

When the coating film has a single layer or multilayer layers, from the viewpoint of improving processability, the film thickness of the coating film in contact with the chemical conversion coating is preferably 25 μm or less, more preferably 20 μm or less, and still more preferably 10 μm or less.

[Method of Forming Coating Film]

The coating film is formed by applying a coating liquid and then drying and curing the coating film.

The coating method of the coating film is not particularly limited, and examples thereof include an immersion method, a curtain flow method, a roll coating method, a bar coating method, an electrostatic method, a brush coating method, a T-die method, a lamination method, and a spray method. A wet-on-wet coating method and a multilayer simultaneous coating method are also exemplified.

For heating and curing, any method such as hot air, near infrared rays, far infrared rays, high frequency induction heating, or a heating method by any combination thereof can be applied.

[Specific Aspect of Coated Plated Steel Sheet]

The coated and plated steel sheet according to the disclosure is a pre-coated steel sheet.

The pre-coated steel sheet is a flat steel sheet obtained by forming a coating film on a steel sheet before molding. The coating film to be formed on the steel sheet before molding is a coating film in the coated and plated steel sheet according to the disclosure.

On the other hand, the coated and plated steel sheet according to the disclosure does not have an electrodeposition coating film. That is, the coated and plated steel sheet according to the disclosure is a steel sheet having a coating film as an outermost surface.

<Coated Plated Steel Strip>

A coated and plated steel strip according to the present embodiment is strip-shaped steel.

Examples of the shape of the coated and plated steel strip according to the present embodiment include a coated and plated steel strip wound in a coil shape.

The configuration of the coated and plated steel strip according to the present embodiment has the same configuration as that of the coated and plated steel sheet except that the coated and plated steel strip has a strip shape.

The coated and plated steel strip is obtained, for example, by winding the coated and plated steel sheet into a coil shape.

The method of winding the coated and plated steel sheet into a coil shape is not particularly limited, and examples thereof include a method using a known winding machine.

EXAMPLES

Hereinafter, the disclosure will be described more specifically with reference to Examples. However, these examples do not limit the disclosure.

(1) Zinc-Based Plated Steel Sheet

A zinc-based plated steel sheet having a zinc-based plating layer on both surfaces as shown in Table 1 was prepared. As the zinc-based plated steel sheet, a soft steel sheet having a sheet thickness of 0.5 mm was used. The surface of the zinc-based plated steel sheet was subjected to alkali degreasing treatment, and water washing and drying, and then used.

(2) Formation of Chemical Conversion Coating

A chemical conversion agent for forming a chemical conversion coating was prepared by blending a Ce compound shown in Table 2, a resin shown in Table 3, a silane coupling agent shown in Table 4, a zirconium compound shown in Table 5, silica shown in Table 6, phosphoric acid and a salt thereof shown in Table 7, a fluoride shown in Table 8, and a vanadium compound shown in Table 9 in blending amounts shown in Table 12 (dry film concentration=% by mass with respect to the solid content of the chemical conversion film), and stirring the blend using a disperser.

The chemical conversion agent was applied to both surfaces of the zinc-based plated steel sheet prepared in the above (1) with a roll coater so as to have an adhesion amount of 100 mg/m$^2$ per one surface, and dried at a steel sheet attainment temperature of 100° C. to form a chemical conversion coating.

The content (concentration of dry film) of each component of the chemical conversion coating in Table 12 is % by mass with respect to the coating solid content. In Table 12, the blending amounts of the resin, the silane coupling agent, the zirconium compound, the silica, the phosphoric acid and the salt thereof, the fluoride, and the vanadium compound in the chemical conversion coating excluding the Ce compound are described in units of 1%. Therefore, the total of all the blending amounts including the Ce compound is not necessarily 100%.

(3) Coating Film

A coating liquid for forming a coating film was prepared by blending a Ce compound shown in Table 2, a resin shown in Table 10, and a pigment shown in Table 11 in blending amounts shown in Table 12 (dry film concentration=% by mass with respect to the solid content of the coating film), and stirring them using a disperser.

The coating liquid was applied to both surfaces of the zinc-based plated steel sheet having a chemical conversion coating prepared in the above (2) with a roll coater so as to have a predetermined film thickness, and dried at a steel sheet attainment temperature of 220° C. to form a coating film.

When the coating film had two layers, FLC100 paint manufactured by Nippon Paint Coatings Co., Ltd. was further applied to the coating film (lower layer coating film) in contact with the chemical conversion coating with a roll coater so as to have a thickness of 15 μm, and dried at a substrate attainment temperature of 230° C. to form a coating film.

The content (concentration of dry film) of each component of the coating film in Table 12 is % by mass with respect to the coating solid content.

(4) Evaluation Method and Evaluation Criteria

A test plate was collected from the coated and plated steel sheet obtained in the above (3), and the test plate was evaluated according to the following evaluation method and evaluation criteria.

(Cross-Cut White Rust Width)

The end surface of the test plate (size: 50×100 mm) was tape-sealed, and the steel sheet was cross-cut with a cutter knife so that the steel sheet base was scratched, and then a combined cycle corrosion test in accordance with CCT-JASO M609 was performed for 60 cycles. The maximum value of the white rust width of plating from the cross-cut of the test plate after the test was measured and evaluated according to the following evaluation criteria.

Score 5: The white rust width is less than 2 mm.

Score 4: The white rust width is 2 mm or more but less than 4 mm.

Score 3: The white rust width is 4 mm or more but less than 6 mm.

Score 2: The white rust width is 6 mm or more but less than 8 mm.

Score 1: The white rust width is 8 mm or more.

(White Rust of Erichsen Processed Portion)

The end surface of the test plate (size: 50×100 mm) was tape-sealed, 6-mm Erichsen extrusion was then performed at the center of the test plate, and a combined cycle corrosion test in accordance with CCT-JASO M609 was performed for 60 cycles. The plating white rust ratio in the circular portion extruded by Erichsen processing of the test plate after the test was measured and evaluated according to the following evaluation criteria.

Score 5: The area proportion of white rust is less than 20%.

Score 4: The area proportion of white rust is 20% or more but less than 30%.

Score 3: The area proportion of white rust is 30% or more but less than 40%.

Score 2: The area proportion of white rust is 40% or more but less than 50%.

Score 1: The area proportion of white rust is 50% or more.

The "solubility in water (0.10% or more)" in Table 2 is denoted as "Y" when 0.10 g or more of the corresponding cerium compound is dissolved with respect to 100 g of water at room temperature. On the other hand, a case in which less than 0.10 g of the cerium compound is dissolved is denoted as "N".

TABLE 1

| No. | Plated steel sheet (% = % by mass) |
|---|---|
| a1 | Hot-dip zinc-plated steel sheet |
| a2 | Zn-11% Al-3% Mg-0.2% Si hot-dip zinc alloy-plated steel sheet |
| a3 | Zn-6% Al-3% Mg hot-dip zinc alloy-plated steel sheet |
| a4 | Zn-55% Al-2% Mg-1.6% Si hot-dip zinc alloy-plated steel sheet |
| a5 | Zn-55% Al-1.6% Si hot-dip zinc alloy-plated steel sheet |

TABLE 2

| No. | Ce compound | Solubility in water (0.10% or more) |
|---|---|---|
| b1 | Diammonium cerium(IV) nitrate | Y |
| b2 | Cerium(III) chloride heptahydrate | Y |
| b3 | Cerium(III) nitrate hexahydrate | Y |
| b4 | Cerium(III) sulfate octahydrate | Y |
| b5 | Cerium(IV) oxide | N |
| b6 | Cerium(III) phosphate | N |
| b7 | Cerium(III) carbonate octahydrate | N |

TABLE 3

| No. | Resin of chemical conversion coating |
|---|---|
| f1 | Polyester resin |
| f2 | Urethane resin |
| f3 | Epoxy resin |
| f4 | Phenol resin |
| f5 | Acrylic resin |

TABLE 4

| No. | Silane coupling agent of chemical conversion coating |
|---|---|
| g1 | 3-Glycidyloxypropyltrimethoxysilane |
| g2 | 3-Aminopropyltriethoxysilane |

TABLE 5

| No. | Zirconium compound of chemical conversion coating |
|---|---|
| h1 | Ammonium zirconium carbonate |

TABLE 6

| No. | Silica of chemical conversion coating |
|---|---|
| i1 | Colloidal silica |

TABLE 7

| No. | Phosphoric acid and salt thereof of chemical conversion coating |
|---|---|
| j1 | Phosphoric acid |
| j2 | Ammonium phosphate |

TABLE 8

| No. | Fluoride of chemical conversion coating |
|---|---|
| k1 | Fluorotitanic acid |
| k2 | Ammonium fluoride |

TABLE 9

| No. | Vanadium compound of chemical conversion coating |
|---|---|
| l1 | Vanadium acetylacetonate |

TABLE 10

| No. | Resin of lower layer coating film (first layer) in contact with chemical conversion coating |
|---|---|
| m1 | Polyester resin |
| m2 | Acrylic resin |
| m3 | Epoxy resin |
| m4 | Urethane resin |
| m5 | Butylmethyl-mixed melamine resin |
| m6 | Isocyanate resin |

TABLE 11

| No. | Pigment of lower layer coating film (first layer) in contact with chemical conversion coating |
|---|---|
| n1 | Calcium vanadate-magnesium |
| n2 | Sodium tungstate |
| n3 | Sodium silicate |
| n4 | calcium ion-exchanged silica (manufactured by W. R. Grace & Co.-Conn.: SHIELDEX C303) |
| n5 | Aluminum phosphate (manufactured by TAYCA CORPORATION: K-WHITE #82) |

TABLE 12

| | | Plated steel sheet | | Chemical conversion coating | | | | | | | | | | | | | | | | |
|---|---|---|---|---|---|---|---|---|---|---|---|---|---|---|---|---|---|---|---|---|
| | | | Adhesion amount per one surface of plating layer/ $g \cdot m^{-2}$ | Adhesion amount per one surface/ $mg \cdot m^{-2}$ | Ce compound | | Resin | | Silane coupling agent | | Zirconium compound | | Silica | | Phosphoric acid and salt thereof | | Fluoride | | Vanadium compound | |
| | No. | Type | | | Type | Dry film concentration | Type | Dry film concentration | Type | Dry film concentration | Type | Dry film concentration | Type | Dry film concentration | Type | Dry film concentration | Type | Dry film concentration | Type | Dry film concentration |
| Comparative Example | 1 | a1 | 40 | 100 | — | — | f1 | 70 | g1 | 30 | — | — | — | — | — | — | — | — | — | — |
| Comparative Example | 2 | a2 | 40 | 100 | — | — | f1 | 70 | g1 | 30 | — | — | — | — | — | — | — | — | — | — |
| Comparative Example | 3 | a3 | 40 | 100 | — | — | f1 | 70 | g1 | 30 | — | — | — | — | — | — | — | — | — | — |
| Comparative Example | 4 | a4 | 75 | 100 | — | — | f1 | 70 | g1 | 30 | — | — | — | — | — | — | — | — | — | — |
| Comparative Example | 5 | a5 | 75 | 100 | — | — | f1 | 70 | g1 | 30 | — | — | — | — | — | — | — | — | — | — |
| Comparative Example | 6 | a1 | 40 | 100 | — | — | f2 | 70 | g2 | 30 | — | — | — | — | — | — | — | — | — | — |
| Comparative Example | 7 | a2 | 40 | 100 | — | — | f2 | 70 | g2 | 30 | — | — | — | — | — | — | — | — | — | — |
| Comparative Example | 8 | a3 | 40 | 100 | — | — | f2 | 70 | g2 | 30 | — | — | — | — | — | — | — | — | — | — |
| Comparative Example | 9 | a4 | 75 | 100 | — | — | f2 | 70 | g2 | 30 | — | — | — | — | — | — | — | — | — | — |
| Comparative Example | 10 | a5 | 75 | 100 | — | — | f2 | 70 | g2 | 30 | — | — | — | — | — | — | — | — | — | — |
| Example | 11 | a1 | 40 | 200 | — | — | f1 | 65 | g1 | 35 | — | — | — | — | — | — | — | — | — | — |
| Example | 12 | a2 | 40 | 200 | — | — | f1 | 65 | g1 | 35 | — | — | — | — | — | — | — | — | — | — |
| Example | 13 | a3 | 40 | 200 | — | — | f1 | 65 | g1 | 35 | — | — | — | — | — | — | — | — | — | — |
| Example | 14 | a4 | 75 | 200 | — | — | f1 | 65 | g1 | 35 | — | — | — | — | — | — | — | — | — | — |
| Example | 15 | a5 | 75 | 200 | — | — | f1 | 65 | g1 | 35 | — | — | — | — | — | — | — | — | — | — |
| Example | 16 | a1 | 40 | 200 | — | — | f1 | 65 | g1 | 35 | — | — | — | — | — | — | — | — | — | — |
| Example | 17 | a2 | 40 | 200 | — | — | f1 | 65 | g1 | 35 | — | — | — | — | — | — | — | — | — | — |
| Example | 18 | a3 | 40 | 200 | — | — | f1 | 65 | g1 | 35 | — | — | — | — | — | — | — | — | — | — |
| Example | 19 | a4 | 75 | 200 | — | — | f1 | 65 | g1 | 35 | — | — | — | — | — | — | — | — | — | — |
| Example | 20 | a5 | 75 | 200 | — | — | f1 | 65 | g1 | 35 | — | — | — | — | — | — | — | — | — | — |
| Example | 21 | a4 | 75 | 100 | — | — | f2 | 65 | g1 | 35 | — | — | — | — | — | — | — | — | — | — |
| Example | 22 | a4 | 75 | 100 | — | — | f2 | 65 | g1 | 35 | — | — | — | — | — | — | — | — | — | — |
| Example | 23 | a4 | 75 | 100 | — | — | f2 | 65 | g1 | 35 | — | — | — | — | — | — | — | — | — | — |
| Example | 24 | a4 | 75 | 100 | — | — | f2 | 65 | g1 | 35 | — | — | — | — | — | — | — | — | — | — |
| Example | 25 | a4 | 75 | 100 | — | — | f2 | 65 | g1 | 35 | — | — | — | — | — | — | — | — | — | — |
| Example | 26 | a4 | 75 | 100 | — | — | f2 | 65 | g1 | 35 | — | — | — | — | — | — | — | — | — | — |
| Comparative Example | 27 | a4 | 75 | 100 | — | — | f2 | 65 | g1 | 35 | — | — | — | — | — | — | — | — | — | — |

TABLE 12-continued

| | | | | | | | | | | | | | | | | | | | | |
|---|---|---|---|---|---|---|---|---|---|---|---|---|---|---|---|---|---|---|---|---|
| Comparative Example | 28 | a4 | 75 | 100 | — | — | f2 | 65 | g1 | 35 | — | — | — | — | — | — | — | — | — | — |
| Example | 29 | a4 | 75 | 100 | — | — | f2 | 65 | g1 | 35 | — | — | — | — | — | — | — | — | — | — |
| Example | 30 | a4 | 75 | 100 | — | — | f2 | 65 | g1 | 35 | — | — | — | — | — | — | — | — | — | — |
| Example | 31 | a4 | 75 | 100 | — | — | f2 | 65 | g1 | 35 | — | — | — | — | — | — | — | — | — | — |
| Example | 32 | a4 | 75 | 100 | — | — | f2 | 65 | g1 | 35 | — | — | — | — | — | — | — | — | — | — |
| Example | 33 | a4 | 75 | 100 | — | — | f2 | 65 | g1 | 35 | — | — | — | — | — | — | — | — | — | — |
| Example | 34 | a4 | 75 | 100 | — | — | f2 | 65 | g1 | 35 | — | — | — | — | — | — | — | — | — | — |
| Comparative Example | 35 | a4 | 75 | 100 | — | — | f2 | 65 | g1 | 35 | — | — | — | — | — | — | — | — | — | — |
| Example | 36 | a4 | 75 | 100 | — | — | f2 | 65 | g1 | 35 | — | — | — | — | — | — | — | — | — | — |
| Example | 37 | a4 | 75 | 100 | — | — | f2 | 65 | g1 | 35 | — | — | — | — | — | — | — | — | — | — |
| Example | 38 | a4 | 75 | 100 | — | — | f2 | 65 | g1 | 35 | — | — | — | — | — | — | — | — | — | — |
| Example | 39 | a4 | 75 | 100 | — | — | f2 | 65 | g1 | 35 | — | — | — | — | — | — | — | — | — | — |
| Example | 40 | a4 | 75 | 100 | — | — | f2 | 65 | g1 | 35 | — | — | — | — | — | — | — | — | — | — |
| Example | 41 | a4 | 75 | 100 | — | — | f2 | 65 | g1 | 35 | — | — | — | — | — | — | — | — | — | — |
| Example | 42 | a4 | 75 | 100 | — | — | f2 | 65 | g1 | 35 | — | — | — | — | — | — | — | — | — | — |
| Example | 43 | a4 | 75 | 100 | — | — | f2 | 65 | g1 | 35 | — | — | — | — | — | — | — | — | — | — |
| Example | 44 | a4 | 75 | 100 | — | — | f2 | 65 | g1 | 35 | — | — | — | — | — | — | — | — | — | — |
| Example | 45 | a4 | 75 | 100 | — | — | f2 | 65 | g1 | 35 | — | — | — | — | — | — | — | — | — | — |
| Example | 46 | a4 | 75 | 100 | — | — | f2 | 65 | g1 | 35 | — | — | — | — | — | — | — | — | — | — |
| Example | 47 | a4 | 75 | 100 | — | — | f2 | 65 | g1 | 35 | — | — | — | — | — | — | — | — | — | — |
| Example | 48 | a4 | 75 | 100 | — | — | f2 | 65 | g1 | 35 | — | — | — | — | — | — | — | — | — | — |
| Example | 49 | a4 | 75 | 100 | — | — | f2 | 65 | g1 | 35 | — | — | — | — | — | — | — | — | — | — |
| Example | 50 | a4 | 75 | 100 | — | — | f2 | 70 | — | 0 | h1 | 30 | — | — | — | — | — | — | — | — |
| Example | 51 | a4 | 75 | 100 | — | — | f2 | 75 | — | 0 | h1 | 20 | — | — | j2 | 5 | — | — | — | — |
| Example | 52 | a4 | 75 | 100 | — | — | f2 | 55 | — | 0 | h1 | 15 | i1 | 20 | j2 | 5 | — | — | 11 | 5 |
| Example | 53 | a4 | 75 | 100 | — | — | f2 | 35 | g1 | 35 | — | — | i1 | 30 | — | — | — | — | — | — |
| Example | 54 | a4 | 75 | 100 | — | — | f2 | 60 | g1 | 35 | — | — | — | — | j2 | 5 | — | — | — | — |
| Example | 55 | a4 | 75 | 100 | — | — | f2 | 60 | g1 | 35 | — | — | — | — | — | — | k1 | 5 | — | — |
| Example | 56 | a4 | 75 | 100 | — | — | f2 | 60 | g1 | 35 | — | — | — | — | — | — | — | — | 11 | 5 |
| Example | 57 | a4 | 75 | 100 | — | — | f2 | 35 | g1 | 35 | — | — | i1 | 30 | — | — | — | — | — | — |
| Example | 58 | a4 | 75 | 100 | — | — | f2 | 55 | g1 | 35 | — | — | — | — | j1 | 5 | k1 | 5 | — | — |
| Example | 59 | a4 | 75 | 100 | — | — | f2 | 55 | g1 | 35 | — | — | — | — | j1 | 5 | — | — | 11 | 5 |
| Example | 60 | a4 | 75 | 100 | — | — | f2 | 55 | g1 | 35 | — | — | — | — | — | — | k1 | 5 | 11 | 5 |
| Example | 61 | a4 | 75 | 100 | — | — | f2 | 50 | g1 | 35 | — | — | — | — | j1 | 5 | k1 | 5 | 11 | 5 |
| Example | 62 | a4 | 75 | 100 | — | — | f1 | 55 | g1 | 35 | — | — | — | — | j1 | 5 | k1 | 5 | — | — |
| Example | 63 | a4 | 75 | 100 | — | — | f2 | 55 | g1 | 35 | — | — | — | — | j1 | 5 | k1 | 5 | — | — |
| Example | 64 | a4 | 75 | 100 | — | — | f3 | 55 | g1 | 35 | — | — | — | — | j1 | 5 | k1 | 5 | — | — |
| Example | 65 | a4 | 75 | 100 | — | — | f4 | 55 | g1 | 35 | — | — | — | — | j1 | 5 | k1 | 5 | — | — |
| Example | 66 | a4 | 75 | 40 | — | — | f5 | 55 | g1 | 35 | — | — | — | — | j1 | 5 | k1 | 5 | — | — |
| Example | 67 | a2 | 40 | 40 | — | — | f5 | 50 | g2 | 40 | — | — | — | — | j1 | 5 | k1 | 5 | — | — |
| Example | 68 | a2 | 40 | 40 | — | — | f5 | 50 | g2 | 40 | — | — | — | — | j1 | 5 | k1 | 5 | — | — |
| Example | 69 | a2 | 40 | 40 | — | — | f5 | 50 | g2 | 40 | — | — | — | — | j1 | 5 | k1 | 5 | — | — |
| Example | 70 | a2 | 40 | 40 | — | — | f5 | 50 | g2 | 40 | — | — | — | — | j1 | 5 | k1 | 5 | — | — |
| Example | 71 | a2 | 40 | 40 | — | — | f5 | 50 | g2 | 40 | — | — | — | — | j1 | 5 | k1 | 5 | — | — |
| Comparative Example | 72 | a2 | 40 | 40 | — | — | f5 | 50 | g2 | 40 | — | — | — | — | j1 | 5 | k1 | 5 | — | — |
| Comparative Example | 73 | a2 | 40 | 40 | — | — | f5 | 50 | g2 | 40 | — | — | — | — | j1 | 5 | k1 | 5 | — | — |
| Comparative Example | 74 | a2 | 40 | 40 | — | — | f5 | 50 | g2 | 40 | — | — | — | — | j1 | 5 | k1 | 5 | — | — |
| Example | 75 | a4 | 75 | 40 | — | — | f5 | 50 | g2 | 40 | — | — | — | — | j1 | 5 | k1 | 5 | — | — |

TABLE 12-continued

| | | | | | | | | | | | | | | | | | | | | |
|---|---|---|---|---|---|---|---|---|---|---|---|---|---|---|---|---|---|---|---|---|
| Example | 76 | a4 | 75 | 40 | — | — | f5 | 50 | g2 | 40 | — | — | — | — | j1 | 5 | k1 | 5 | — | — |
| Example | 77 | a4 | 75 | 40 | — | — | f5 | 50 | g2 | 40 | — | — | — | — | j1 | 5 | k1 | 5 | — | — |
| Example | 78 | a4 | 75 | 40 | — | — | f5 | 50 | g2 | 40 | — | — | — | — | j1 | 5 | k1 | 5 | — | — |
| Example | 79 | a4 | 40 | 40 | — | — | f5 | 50 | g2 | 40 | — | — | — | — | j1 | 5 | k1 | 5 | — | — |
| Comparative Example | 80 | a4 | 40 | 40 | — | — | f5 | 50 | g2 | 40 | — | — | — | — | j1 | 5 | kl | 5 | — | — |
| Comparative Example | 81 | a4 | 40 | 40 | — | — | f5 | 50 | g2 | 40 | — | — | — | — | j1 | 5 | k1 | 5 | — | — |
| Comparative Example | 82 | a4 | 40 | 40 | — | — | f5 | 50 | g2 | 40 | — | — | — | — | j1 | 5 | k1 | 5 | — | — |
| Example | 83 | a4 | 40 | 40 | — | — | f5 | 50 | g2 | 40 | — | — | — | — | j2 | 5 | k2 | 5 | — | — |
| Comparative Example | 84 | a4 | 40 | 100 | b1 | 0.01 | f2 | 70 | g2 | 30 | — | — | — | — | — | — | — | — | — | — |
| Comparative Example | 85 | a4 | 40 | 100 | b1 | 1.0 | f2 | 69 | g2 | 30 | — | — | — | — | — | — | — | — | — | — |
| Comparative Example | 86 | a4 | 40 | 100 | b1 | 5.0 | f2 | 65 | g2 | 30 | — | — | — | — | — | — | — | — | — | — |
| Comparative Example | 87 | a4 | 40 | 100 | b1 | 10.0 | f2 | 60 | g2 | 30 | — | — | — | — | — | — | — | — | — | — |

| | | Coating film | | | Coating film in contact with chemical conversion coating (first layer) | | | | | | | | | | | | | | | |
|---|---|---|---|---|---|---|---|---|---|---|---|---|---|---|---|---|---|---|---|---|
| | | | Film | | Ce compound | | Resin | | Vanadate | | Tungstate | | Silicate | | Phosphate | | | | | |
| | | Number | thickness/μm | | | Dry film | | Dry film | | Dry film | | Dry film | | Dry film | | Dry film | | | | |
| | No. | of layers | First layer | Second layer | Type | concen-tration | Type | concen-tration | Type | concen-tration | Type | concen-tration | Type | concen-tration | Type | concen-tration | Cross-cut | Erichsen extrusion |
| Comparative Example | 1 | 2 | 5 | 15 | — | — | m1 + m5 + m6 | 36 + 7 + 7 | n1 | 30 | — | — | — | — | n5 | 20 | 1 | 2 |
| Comparative Example | 2 | 2 | 5 | 15 | — | — | m1 + m5 + m6 | 36 + 7 + 7 | n1 | 30 | — | — | — | — | n5 | 20 | 2 | 1 |
| Comparative Example | 3 | 2 | 5 | 15 | — | — | m1 + m5 + m6 | 36 + 7 + 7 | n1 | 30 | — | — | — | — | n5 | 20 | 2 | 1 |
| Comparative Example | 4 | 2 | 5 | 15 | — | — | m1 + m5 + m6 | 36 + 7 + 7 | n1 | 30 | — | — | — | — | n5 | 20 | 2 | 1 |
| Comparative Example | 5 | 2 | 5 | 15 | — | — | m1 + m5 + m6 | 36 + 7 + 7 | n1 | 30 | — | — | — | — | n5 | 20 | 2 | 1 |
| Comparative Example | 6 | 2 | 5 | 15 | — | — | m3 + m5 + m6 | 36 + 7 + 7 | n1 | 30 | — | — | — | — | n5 | 20 | 1 | 2 |
| Comparative Example | 7 | 2 | 5 | 15 | — | — | m3 + m5 + m6 | 36 + 7 + 7 | n1 | 30 | — | — | — | — | n5 | 20 | 2 | 1 |
| Comparative Example | 8 | 2 | 5 | 15 | — | — | m3 + m5 + m6 | 36 + 7 + 7 | n1 | 30 | — | — | — | — | n5 | 20 | 2 | 1 |
| Comparative Example | 9 | 2 | 5 | 15 | — | — | m3 + m5 + m6 | 36 + 7 + 7 | n1 | 30 | — | — | — | — | n5 | 20 | 2 | 1 |
| Comparative Example | 10 | 2 | 5 | 15 | — | — | m3 + m5 + m6 | 36 + 7 + 7 | n1 | 30 | — | — | — | — | n5 | 20 | 2 | 1 |
| Example | 11 | 2 | 5 | 15 | b1 | 0.1 | m1 + m5 + m6 | 36 + 7 + 7 | n1 | 19.9 | — | — | — | — | n5 | 30 | 3 | 4 |
| Example | 12 | 2 | 5 | 15 | b1 | 0.1 | m1 + m5 + m6 | 36 + 7 + 7 | n1 | 19.9 | — | — | — | — | n5 | 30 | 3 | 4 |

TABLE 12-continued

| | | | | | | | | | | | | | | | | | | |
|---|---|---|---|---|---|---|---|---|---|---|---|---|---|---|---|---|---|---|
| Example | 13 | 2 | 5 | 15 | b1 | 0.1 | m1 + m5 + m6 | 36 + 7 + 7 | n1 | 19.9 | — | — | — | — | n5 | 30 | 3 | 4 |
| Example | 14 | 2 | 5 | 15 | b1 | 0.1 | m1 + m5 + m6 | 36 + 7 + 7 | n1 | 19.9 | — | — | — | — | n5 | 30 | 3 | 4 |
| Example | 15 | 2 | 5 | 15 | b1 | 0.1 | m1 + m5 + m6 | 36 + 7 + 7 | n1 | 19.9 | — | — | — | — | n5 | 30 | 3 | 4 |
| Example | 16 | 2 | 5 | 15 | b3 | 0.1 | m1 + m5 + m6 | 36 + 7 + 7 | n1 | 19.9 | — | — | — | — | n5 | 30 | 3 | 3 |
| Example | 17 | 2 | 5 | 15 | b3 | 0.1 | m1 + m5 + m6 | 36 + 7 + 7 | n1 | 19.9 | — | — | — | — | n5 | 30 | 3 | 3 |
| Example | 18 | 2 | 5 | 15 | b3 | 0.1 | m1 + m5 + m6 | 36 + 7 + 7 | n1 | 19.9 | — | — | — | — | n5 | 30 | 3 | 3 |
| Example | 19 | 2 | 5 | 15 | b3 | 0.1 | m1 + m5 + m6 | 36 + 7 + 7 | n1 | 19.9 | — | — | — | — | n5 | 30 | 3 | 3 |
| Example | 20 | 2 | 5 | 15 | b3 | 0.1 | m1 + m5 + m6 | 36 + 7 + 7 | n1 | 19.9 | — | — | — | — | n5 | 30 | 3 | 3 |
| Example | 21 | 2 | 5 | 15 | b1 | 0.01 | m3 + m5 + m6 | 36 + 7 + 7 | n1 | 19.99 | — | — | — | — | n5 | 30 | 2 | 3 |
| Example | 22 | 2 | 5 | 15 | b1 | 0.1 | m3 + m5 + m6 | 36 + 7 + 7 | n1 | 19.9 | — | — | — | — | n5 | 30 | 3 | 4 |
| Example | 23 | 2 | 5 | 15 | b1 | 0.5 | m3 + m5 + m6 | 36 + 7 + 7 | n1 | 19.5 | — | — | — | — | n5 | 30 | 4 | 5 |
| Example | 24 | 2 | 5 | 15 | b1 | 1.0 | m3 + m5 + m6 | 36 + 7 + 7 | n1 | 19 | — | — | — | — | n5 | 30 | 4 | 5 |
| Example | 25 | 2 | 5 | 15 | b1 | 5.0 | m3 + m5 + m6 | 36 + 7 + 7 | n1 | 15 | — | — | — | — | n5 | 30 | 3 | 4 |
| Example | 26 | 2 | 5 | 15 | b1 | 10.0 | m3 + m5 + m6 | 36 + 7 + 7 | n1 | 10 | — | — | — | — | n5 | 30 | 2 | 3 |
| Comparative Example | 27 | 2 | 5 | 15 | b1 | 12.0 | m3 + m5 + m6 | 30 + 5 + 5 | n1 | 43 | — | — | — | — | n5 | 5 | 2 | 1 |
| Comparative Example | 28 | 2 | 5 | 15 | b3 | 0.005 | m3 + m5 + m6 | 36 + 7 + 7 | n1 | 39.995 | — | — | — | — | n5 | 10 | 2 | 1 |
| Example | 29 | 2 | 5 | 13 | b3 | 0.01 | m3 + m5 + m6 | 36 + 7 + 7 | n1 | 19.99 | — | — | — | — | n5 | 30 | 2 | 2 |
| Example | 30 | 2 | 5 | 13 | b3 | 0.1 | m3 + m5 + m6 | 36 + 7 + 7 | n1 | 19.9 | — | — | — | — | n5 | 30 | 3 | 3 |
| Example | 31 | 2 | 5 | 13 | b3 | 0.5 | m3 + m5 + m6 | 36 + 7 + 7 | n1 | 19.5 | — | — | — | — | n5 | 30 | 4 | 4 |
| Example | 32 | 2 | 5 | 13 | b3 | 1.0 | m3 + m5 + m6 | 36 + 7 + 7 | n1 | 19 | — | — | — | — | n5 | 30 | 4 | 4 |
| Example | 33 | 2 | 5 | 13 | b3 | 5.0 | m3 + m5 + m6 | 30 + 5 + 5 | n1 | 25 | — | — | — | — | n5 | 30 | 3 | 3 |
| Example | 34 | 2 | 5 | 13 | b3 | 10.0 | m3 + m5 + m6 | 36 + 7 + 7 | n1 | 10 | — | — | — | — | n5 | 30 | 2 | 2 |
| Comparative Example | 35 | 2 | 5 | 13 | b3 | 12.0 | m3 + m5 + m6 | 36 + 7 + 7 | n1 | 43 | — | — | — | — | n5 | 5 | 2 | 1 |
| Example | 36 | 1 | 3 | — | b1 | 1.0 | m3 + m5 + m6 | 36 + 7 + 7 | n1 | 19 | — | — | — | — | n5 | 30 | 4 | 5 |
| Example | 37 | 1 | 4 | — | b1 | 1.0 | m3 + m5 + m6 | 36 + 7 + 7 | n1 | 19 | — | — | — | — | n5 | 30 | 4 | 5 |
| Example | 38 | 1 | 10 | — | b1 | 1.0 | m3 + m5 + m6 | 36 + 7 + 7 | n1 | 19 | — | — | — | — | n5 | 30 | 4 | 5 |

TABLE 12-continued

| | | | | | | | | | | | | | | | | | | |
|---|---|---|---|---|---|---|---|---|---|---|---|---|---|---|---|---|---|---|
| Example | 39 | 1 | 15 | — | b1 | 1.0 | m3 + m5 + m6 | 36 + 7 + 7 | n1 | 19 | — | — | — | — | n5 | 30 | 4 | 5 |
| Example | 40 | 2 | 3 | 10 | b1 | 1.0 | m3 + m5 + m6 | 36 + 7 + 7 | n1 | 19 | — | — | — | — | n5 | 30 | 4 | 4 |
| Example | 41 | 2 | 6 | 15 | b1 | 1.0 | m3 + m5 + m6 | 36 + 7 + 7 | n1 | 19 | — | — | — | — | n5 | 30 | 5 | 5 |
| Example | 42 | 2 | 10 | 20 | b1 | 1.0 | m3 + m5 + m6 | 36 + 7 + 7 | n1 | 19 | — | — | — | — | n5 | 30 | 5 | 5 |
| Example | 43 | 2 | 7 | 20 | b1 | 1.0 | m1 + m6 | 36 + 14 | n1 | 19 | — | — | — | — | n5 | 30 | 5 | 5 |
| Example | 44 | 2 | 7 | 20 | b1 | 1.0 | m2 + m6 | 36 + 14 | n1 | 19 | — | — | — | — | n5 | 30 | 4 | 5 |
| Example | 45 | 2 | 7 | 20 | b1 | 1.0 | m3 + m6 | 36 + 14 | n1 | 19 | — | — | — | — | n5 | 30 | 4 | 5 |
| Example | 46 | 2 | 7 | 20 | b1 | 1.0 | m4 + m6 | 36 + 14 | n1 | 19 | — | — | — | — | n5 | 30 | 4 | 5 |
| Example | 47 | 2 | 5 | 15 | b1 | 1.0 | m3 + m5 + m6 | 36 + 7 + 7 | - | 0 | n2 | 19 | — | — | n5 | 30 | 4 | 5 |
| Example | 48 | 2 | 5 | 15 | b1 | 1.0 | m3 + m5 + m6 | 36 + 7 + 7 | - | 0 | — | — | n3 | 19 | n5 | 30 | 4 | 5 |
| Example | 49 | 2 | 5 | 15 | b1 | 1.0 | m3 + m5 + m6 | 36 + 7 + 7 | - | 0 | — | — | n4 | 19 | n5 | 30 | 4 | 5 |
| Example | 50 | 2 | 5 | 15 | b1 | 1.0 | m3 + m5 + m6 | 36 + 7 + 7 | n1 | 19 | — | — | — | — | n5 | 30 | 4 | 5 |
| Example | 51 | 2 | 5 | 15 | b1 | 1.0 | m3 + m5 + m6 | 36 + 7 + 7 | n1 | 19 | — | — | — | — | n5 | 30 | 4 | 5 |
| Example | 52 | 2 | 5 | 15 | b1 | 1.0 | m3 + m5 + m6 | 36 + 7 + 7 | n1 | 19 | — | — | — | — | n5 | 30 | 4 | 5 |
| Example | 53 | 2 | 5 | 15 | b1 | 1.0 | m3 + m5 + m6 | 36 + 7 + 7 | n1 | 19 | — | — | — | — | n5 | 30 | 4 | 5 |
| Example | 54 | 2 | 5 | 15 | b1 | 1.0 | m3 + m5 + m6 | 36 + 7 + 7 | n1 | 19 | — | — | — | — | n5 | 30 | 4 | 5 |
| Example | 55 | 2 | 5 | 15 | b1 | 1.0 | m3 + m5 + m6 | 36 + 7 + 7 | n1 | 19 | — | — | — | — | n5 | 30 | 4 | 5 |
| Example | 56 | 2 | 5 | 15 | b1 | 1.0 | m3 + m5 + m6 | 36 + 7 + 7 | n1 | 19 | — | — | — | — | n5 | 30 | 4 | 5 |
| Example | 57 | 2 | 5 | 15 | b1 | 1.0 | m3 + m5 + m6 | 36 + 7 + 7 | n1 | 19 | — | — | — | — | n5 | 30 | 4 | 5 |
| Example | 58 | 2 | 5 | 15 | b1 | 1.0 | m3 + m5 + m6 | 36 + 7 + 7 | n1 | 19 | — | — | — | — | n5 | 30 | 4 | 5 |
| Example | 59 | 2 | 5 | 15 | b1 | 1.0 | m3 + m5 + m6 | 36 + 7 + 7 | n1 | 19 | — | — | — | — | n5 | 30 | 4 | 5 |
| Example | 60 | 2 | 5 | 15 | b1 | 1.0 | m3 + m5 + m6 | 36 + 7 + 7 | n1 | 19 | — | — | — | — | n5 | 30 | 4 | 5 |
| Example | 61 | 2 | 5 | 15 | b1 | 1.0 | m3 + m5 + m6 | 36 + 7 + 7 | n1 | 19 | — | — | — | — | n5 | 30 | 4 | 5 |
| Example | 62 | 2 | 6 | 18 | b1 | 1.0 | m3 + m5 + m6 | 36 + 7 + 7 | n1 | 19 | — | — | — | — | n5 | 30 | 4 | 5 |
| Example | 63 | 2 | 6 | 18 | b1 | 1.0 | m3 + m5 + m6 | 36 + 7 + 7 | n1 | 19 | — | — | — | — | n5 | 30 | 4 | 5 |
| Example | 64 | 2 | 6 | 18 | b1 | 1.0 | m3 + m5 + m6 | 36 + 7 + 7 | n1 | 19 | — | — | — | — | n5 | 30 | 4 | 5 |
| Example | 65 | 2 | 6 | 18 | b1 | 1.0 | m3 + m5 + m6 | 36 + 7 + 7 | n1 | 19 | — | — | — | — | n5 | 30 | 4 | 5 |
| Example | 66 | 2 | 6 | 18 | b1 | 1.0 | m3 + m5 + m6 | 36 + 7 + 7 | n1 | 19 | — | — | — | — | n5 | 30 | 4 | 5 |

TABLE 12-continued

| | | | | | | | | | | | | | | | | | | |
|---|---|---|---|---|---|---|---|---|---|---|---|---|---|---|---|---|---|---|
| Example | 67 | 2 | 5 | 15 | b1 | 1.0 | m3 + m5 + m6 | 36 + 7 + 7 | n1 | 9 | — | — | n4 | 10 | n5 | 30 | 4 | 5 |
| Example | 68 | 2 | 5 | 15 | b2 | 1.0 | m3 + m5 + m6 | 36 + 7 + 7 | n1 | 9 | — | — | n4 | 10 | n5 | 30 | 3 | 3 |
| Example | 69 | 2 | 5 | 15 | b3 | 1.0 | m3 + m5 + m6 | 36 + 7 + 7 | n1 | 9 | — | — | n4 | 10 | n5 | 30 | 4 | 4 |
| Example | 70 | 2 | 5 | 15 | b4 | 1.0 | m3 + m5 + m6 | 36 + 7 + 7 | n1 | 9 | — | — | n4 | 10 | n5 | 30 | 4 | 4 |
| Example | 71 | 2 | 7 | 15 | b1 + b3 | 0.5 + 0.5 | m3 + m5 + m6 | 36 + 7 + 7 | n1 | 9 | — | — | n4 | 10 | n5 | 30 | 5 | 5 |
| Comparative Example | 72 | 2 | 5 | 15 | b5 | 1.0 | m3 + m5 + m6 | 36 + 7 + 7 | n1 | 9 | — | — | n4 | 10 | n5 | 30 | 2 | 1 |
| Comparative Example | 73 | 2 | 5 | 15 | b6 | 1.0 | m3 + m5 + m6 | 36 + 7 + 7 | n1 | 9 | — | — | n4 | 10 | n5 | 30 | 2 | 1 |
| Comparative Example | 74 | 2 | 5 | 15 | b7 | 1.0 | m3 + m5 + m6 | 36 + 7 + 7 | n1 | 9 | — | — | n4 | 10 | n5 | 30 | 2 | 1 |
| Example | 75 | 2 | 5 | 15 | b1 | 1.0 | m3 + m5 + m6 | 36 + 7 + 7 | n1 | 9 | — | — | n4 | 10 | n5 | 30 | 4 | 5 |
| Example | 76 | 2 | 5 | 15 | b2 | 1.0 | m3 + m5 + m6 | 36 + 7 + 7 | n1 | 9 | — | — | n4 | 10 | n5 | 30 | 3 | 3 |
| Example | 77 | 2 | 5 | 15 | b3 | 1.0 | m3 + m5 + m6 | 36 + 7 + 7 | n1 | 9 | — | — | n4 | 10 | n5 | 30 | 4 | 4 |
| Example | 78 | 2 | 5 | 15 | b4 | 1.0 | m3 + m5 + m6 | 36 + 7 + 7 | n1 | 9 | — | — | n4 | 10 | n5 | 30 | 4 | 4 |
| Example | 79 | 2 | 5 | 15 | b1 + b3 | 0.5 + 0.5 | m3 + m5 + m6 | 36 + 7 + 7 | n1 | 9 | — | — | n4 | 10 | n5 | 30 | 5 | 5 |
| Comparative Example | 80 | 2 | 5 | 15 | b5 | 1.0 | m3 + m5 + m6 | 36 + 7 + 7 | n1 | 9 | — | — | n4 | 10 | n5 | 30 | 2 | 1 |
| Comparative Example | 81 | 2 | 5 | 15 | b6 | 1.0 | m3 + m5 + m6 | 36 + 7 + 7 | n1 | 9 | — | — | n4 | 10 | n5 | 30 | 2 | 1 |
| Comparative Example | 82 | 2 | 5 | 15 | b7 | 1.0 | m3 + m5 + m6 | 36 + 7 + 7 | n1 | 9 | — | — | n4 | 10 | n5 | 30 | 2 | 1 |
| Example | 83 | 2 | 7 | 20 | b1 | 1.0 | m1 + m5 + m6 | 36 + 7 + 7 | n1 | 19 | — | — | — | — | n5 | 30 | 4 | 5 |
| Comparative Example | 84 | 2 | 5 | 15 | — | — | m3 + m5 + m6 | 36 + 7 + 7 | n1 | 30 | — | — | — | — | n5 | 20 | 2 | 1 |
| Comparative Example | 85 | 2 | 5 | 15 | — | — | m3 + m5 + m6 | 36 + 7 + 7 | n1 | 30 | — | — | — | — | n5 | 20 | 2 | 1 |
| Comparative Example | 86 | 2 | 5 | 15 | — | — | m3 + m5 + m6 | 36 + 7 + 7 | n1 | 30 | — | — | — | — | n5 | 20 | 2 | 1 |
| Comparative Example | 87 | 2 | 5 | 15 | — | — | m3 + m5 + m6 | 36 + 7 + 7 | n1 | 30 | — | — | — | — | n5 | 20 | 2 | 1 |

It is found that the coated and plated steel sheet containing a specific cerium compound in the coating film in contact with the chemical conversion coating (Test Nos. 11 to 26, 29 to 34, 36 to 71, 75 to 79, and 83) has a small cross-cut white rust width and a small white rust area proportion in the Erichsen processed portion.

On the other hand, it is found that the coated and plated steel sheet containing no specific cerium compound in the coating film in contact with the chemical conversion coating (Test Nos. 1 to 10, 27, 28, 35, 72 to 74, 80 to 82, and 84 to 87) has a cross-cut white rust width and a white rust area proportion in the Erichsen processed portion larger than those of the coated and plated steel sheet containing a specific cerium compound.

The coated and plated steel sheet containing a specific cerium compound in the chemical conversion coating (Test Nos. 84 to 87) had the same scores of the cross-cut white rust width and the white rust of the Erichsen processed portion described in the table as those of the coated and plated steel sheet of Test No. 2, but the coated and plated steel sheet containing a specific cerium compound in the chemical conversion coating (Test Nos. 84 to 87) had a smaller cross-cut white rust width and a smaller white rust area proportion in the Erichsen processed portion.

From the above results, it is found that the present examples also have high corrosion resistance while suppressing the generation of white rust even when cracks are generated in the plating layer or the coating film by bending, pressing, or the like without using harmful hexavalent chromium.

The invention claimed is:

1. A coated and plated steel sheet or coated and plated steel strip comprising:

a steel sheet or a steel strip;

a plating layer provided on one surface or both surfaces of the steel sheet or steel strip and containing zinc;

a chemical conversion coating provided on the plating layer provided on one surface of the steel sheet or steel strip or provided on at least one of plating layers provided on both surfaces of the steel sheet or steel strip; and a single-layer coating film or multilayer coating film provided on the chemical conversion coating, wherein the single-layer coating film provided on the chemical conversion coating or a coating film, of the multilayer coating film, which is in contact with the chemical conversion coating, contains from 0.01 to 10.0% by mass of a cerium compound capable of being dissolved in an amount of 0.10 g or more with respect to 100 g of water at room temperature, with respect to a solid content of the single-layer coating film provided on the chemical conversion coating or the coating film, of the multilayer coating film, which is in contact with the chemical conversion coating, and wherein the cerium compound includes a cerium(IV) compound.

2. The coated and plated steel sheet or coated and plated steel strip according to claim 1, wherein the cerium compound includes a cerium(III) compound.

3. The coated and plated steel sheet or coated and plated steel strip according to claim 1, wherein the cerium(IV) compound includes diammonium cerium(IV) nitrate.

4. The coated and plated steel sheet or coated and plated steel strip according to claim 1, wherein in the single-layer coating film provided on the chemical conversion coating or the coating film, of the multilayer coating film, which is in contact with the chemical conversion coating, a content of cerium chloride is 0.01% by mass or less with respect to a solid content of the single-layer coating film provided on the chemical conversion coating or the coating film, of the multilayer coating film, which is in contact with the chemical conversion coating.

5. The coated and plated steel sheet or coated and plated steel strip according to claim 1, wherein the plating layer has a chemical composition consisting of, by mass %, Al: from 0 to 60.0%,
Mg: from 0 to 15.0%,
Si: from 0 to 2.0%,
Ni: from 0 to 1.0%,
Cr: from 0 to 1.0%,
Ti: from 0 to 1.0%, and
balance: Zn and impurities.

6. The coated and plated steel sheet or coated and plated steel strip according to claim 1, wherein the plating layer has a chemical composition consisting of, by mass %, Al: from 0.5 to 60.0%,
Mg: from 0.5 to 15.0%,
Si: from 0 to 2.0%,
Ni: from 0 to 1.0%,
Cr: from 0 to 1.0%,
Ti: from 0 to 1.0%, and
balance: Zn and impurities.

7. The coated and plated steel sheet or coated and plated steel strip according to claim 1, wherein a film thickness of the single-layer coating film provided on the chemical conversion coating or the coating film, of the multilayer coating film, which is in contact with the chemical conversion coating, is more than 5 μm.

8. The coated and plated steel sheet or coated and plated steel strip according to claim 1, wherein the single-layer coating film provided on the chemical conversion coating or the coating film, of the multilayer coating film, which is in contact with the chemical conversion coating contains one or more of a polyester resin, an epoxy resin, an acrylic resin, or a urethane resin.

9. The coated and plated steel sheet or coated and plated steel strip according to claim 1, wherein the single-layer coating film provided on the chemical conversion coating or the coating film, of the multilayer coating film, which is in contact with the chemical conversion coating contains one or more of vanadate, tungstate, silicate, or phosphate.

* * * * *